US011903477B2

(12) United States Patent
Zheng et al.

(10) Patent No.: US 11,903,477 B2
(45) **Date of Patent: *Feb. 20, 2024**

(54) REFILLABLE CONTAINER

(71) Applicant: APR Beauty Group, Inc., Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/311,140

(22) Filed: May 2, 2023

(65) Prior Publication Data

US 2023/0263287 A1 Aug. 24, 2023

Related U.S. Application Data

(63) Continuation of application No. 17/000,027, filed on Aug. 21, 2020, now abandoned.

(51) Int. Cl.
*A45D 40/06* (2006.01)
*A45D 40/00* (2006.01)

(52) U.S. Cl.
CPC ..... *A45D 40/06* (2013.01); *A45D 2040/005* (2013.01); *A45D 2040/0037* (2013.01)

(58) Field of Classification Search
CPC ..... A45D 40/06; A45D 40/02; A45D 40/023; A45D 40/026; A45D 40/04; A45D 40/065; A45D 2040/0037; A45D 2040/005
USPC ..... 401/78, 86, 63; 132/318, 317, 218, 297; 206/385
See application file for complete search history.

(56) References Cited

U.S. PATENT DOCUMENTS

| | | | | |
|---|---|---|---|---|
| 4,505,607 | A | 3/1985 | Sugiyama | |
| 5,399,040 | A | 3/1995 | Holloway | |
| 9,723,907 | B2 | 8/2017 | Huang et al. | |
| 2018/0344011 | A1* | 12/2018 | Paquet | A45D 40/22 |

* cited by examiner

*Primary Examiner* — King M Chu
(74) *Attorney, Agent, or Firm* — Jason Lee DeFrancesco

(57) ABSTRACT

A refillable container for a stick type cosmetic product comprising a cap, a refill cartridge and a base assembly. The base assembly comprises an outer shell and a button member. The refill cartridge is configured to be detachably received at least partially within a cavity of the outer shell of the base assembly such that the refill cartridge may be removed and replaced from said base assembly by pressing the button member provided in the base assembly.

15 Claims, 15 Drawing Sheets

REFILLABLE CONTAINER

CROSS-REFERENCE TO RELATED APPLICATION

This application is a continuation-in-part of U.S. patent application Ser. No. 17/000,027 filed Aug. 21, 2020, which is incorporated by reference in its entirety.

BACKGROUND

Field of the Invention

The present disclosure relates generally to a refillable container for a stick type cosmetic product.

Description of the Related Art

Stick type cosmetic products such as lipstick for adding color, texture, and protection to the skin has been available in cylindrical metal tubes since 1915.

A user conventionally must buy a stick dispensing container with the stick product, such as for example lipstick, adding significant cost. Since the cost of the lipstick product and dispenser combination is relatively high, a manufacturer may limit the number of lipstick types or lipstick colors to be offered, to avoid an overstock of relatively expensive dispensers containing less popular lipstick colors or shade variations.

Refill containers for consumer products are considered environmental friendly in a way that lesser material is utilized in their manufacturing. These are also economical for the consumers as well as manufacturers. The consumers don't have to spend the same amount of money for the refills while for manufacturers they enable lower consumption of inputs such as raw materials and energy. Various attempts have been made to refine make-up packages such as compacts, lipsticks, etc. to provide an option of refilling the product.

The known refill containers for cosmetic products generally comprise of a refillable container that houses the product which may or may not have a propelling/dispensing mechanism therefore and such refills are then replaced into the refillable container once the product is used by the user. For example, there are available stick product packages which are refillable where a refill cartridge is replaced once the stick is used up by the user.

Most of the refillable packages are available for stick consumer products. For example, U.S. Pat. No. 4,505,607 to Sugiyama discloses a retractable-type cosmetic container that includes a holder having a cosmetic projecting-retracting means and adapted to be mounted on a manipulating member provided separately from the holder, and a cap closure. An inner tube of the holder is provided at its lower end with an opening of angular shape within which a hollow projection of the manipulating member is detachably engaged for unitary rotation of the member and the inner tube.

Similarly, U.S. Pat. No. 5,399,040 to Holloway discloses a refill cartridge comprising a cosmetic holder including a tubular inner body, a tubular cam sleeve covering tubular inner body, and an elevator cup within inner body and a retaining means is provided to hold the refill and the base member together.

U.S. Pat. No. 9,723,907 B2 to Huang et al. discloses a lipstick dispenser incorporates a screw type catch or magnetic catch that enables replacement of lipstick within the dispenser. Lipstick refills may be installed and removed from the dispenser with an extractor. In another implementation, the dispenser includes a sleeve that is arranged to extent and retract within the dispenser, to provide access to the lipstick for removal and/or installation.

There is still a need for an improved refillable container in which removal and attachment of the refill is simple and easy.

SUMMARY

Accordingly, there is provided a refillable container for a stick type cosmetic product comprising a cap, a refill cartridge and a base assembly. The cap is detachably attached to the base assembly. The refill cartridge is configured to be detachably received at least partially within a cavity of the outer shell of the base assembly such that the refill cartridge can be replaced when a stick type cosmetic product held within the refill cartridge is used up by a consumer. The base assembly and the cap are thus retained for re-use, while the refill cartridge can be replaced with a new refill cartridge. The refill cartridge may be removed and replaced from said base assembly by pressing a button member provided in the base assembly.

According to an aspect of the present disclosure, the base assembly comprises an outer shell, the button member, a limiting member, a sliding member and a spring. The outer shell is a body with a sidewall, a bottom wall, an opening at its distal end, and defining the cavity to receive the refill cartridge therein.

According to an aspect of the present disclosure, the outer shell of the base assembly includes features on its outer surface to detachably connect to the cap. In a preferred embodiment, the outer shell comprises at least one bead on its outer surface and the cap includes a corresponding groove at its inner surface for snap fitment. In alternative embodiments, the cap and the outer shell of the base assembly may be removably secured to each other by any other method known in the art.

According to another aspect of the present disclosure, the refill cartridge includes an inner sleeve, a spiral cam sleeve, a carrier cup and an outer sleeve. The inner sleeve comprises an upper cylindrical portion having a cylindrical sidewall, an open top end, a closed bottom wall, and at least one longitudinal slot in the cylindrical sidewall thereof. Further, a tubular projection extends downwardly from an outer surface of the closed bottom wall of the upper cylindrical portion of the inner sleeve. The tubular projection of the inner sleeve comprises a cylindrical distal portion, a cylindrical rim portion and a conical portion. The conical portion is stepped in from the cylindrical rim portion and extends between the cylindrical distal portion and the cylindrical rim portion. The spiral cam sleeve surrounds the upper cylindrical portion of the inner sleeve and is provided with a spiral groove extending throughout the length of said spiral cam sleeve on an inner surface of the spiral cam sleeve. The carrier cup has an actuating pin projecting laterally from an outer surface of said carrier cup. The carrier cup is slidably movable inside said inner sleeve and wherein the actuating pin projects through the longitudinal slot of the inner sleeve engages with said spiral slot of the spiral cam sleeve, whereby turning movement of the inner sleeve relative to the spiral cam sleeve propels the carrier cup towards the open end of the inner sleeve or retract it therefrom. The outer sleeve is tightly surrounding the spiral cam sleeve and holding it in radially compressed condition whereby relative turning movement between the outer sleeve and the spiral cam sleeve is prevented.

After the refill cartridge is assembled with the base assembly, a user holds the outer sleeve, and rotates the outer shell of the base assembly, causing rotation of the inner sleeve, while the spiral cam sleeve remains static. As a result, the actuating pin of the carrier cup moves in the spiral groove of the spiral cam sleeve, driving the carrier cup to move up or down in the inner sleeve.

More particularly, during use, the user rotates the outer shell of the base assembly in a first direction, the carrier cup in an upward direction to expose the cosmetic product in the carrier cup from the opening at the distal end of the inner sleeve.

After use, the user rotates the outer shell in a second direction opposite to the first direction, which causes the carrier cup to move in a downward direction to hide the cosmetic product in the inner sleeve.

In alternate embodiments, other types of retractable operators may be used in place of the cam and slot arrangement which is explained in the present disclosure, such as vertical slide type or push type or any other mechanism known in the art.

According to yet another aspect of the present disclosure, the outer shell of the base assembly comprises at least one sidewall and the bottom wall. An aperture for receiving a portion of the button member is formed in the outer shell at one sidewall. An inner surface of the sidewall of the outer shell comprises an inner step near a distal end portion of the outer shell. A rotation lock portion is provided on the inner surface of the sidewall of the outer shell located above the inner step, and wherein the rotation lock portion comprises a plurality of first ribs, which is evenly distributed in a circumferential direction on the inner surface of the sidewall of the outer shell. Further, an annular cylindrical outer surface which is stepped out from a lower portion of the cylindrical sidewall of the inner sleeve comprises a plurality of second ribs which are evenly distributed in a circumferential direction. The plurality of first ribs of the outer shell engages with the plurality of second ribs of the inner sleeve to prevent the inner sleeve from rotation relative to the outer shell of the base assembly.

According to yet another aspect of the present disclosure, the outer shell of the base assembly is configured to receive the tubular projection of the inner sleeve of the refill cartridge within the cavity of the outer shell below the inner step of the outer shell, while the upper cylindrical portion of the inner sleeve is received within the cavity of the outer shell above the inner step such that the bottom wall of the upper cylindrical portion of the inner sleeve rests on the inner step of the outer shell.

According to yet another aspect of the present disclosure, the button member comprises a button portion and a gripping portion. The gripping portion comprises a pair of arcuate portions opposite to each other in a circumferential direction. When assembled to the outer shell of the base assembly, the button portion is exposed to an outer side through the aperture formed in the sidewall of the outer shell of the base assembly, while the pair of arcuate portions lies within the cavity of the outer shell. The pair of arcuate portions of the button member is elastically deformable. Further, a first end of each of the arcuate portions is connected to an inner surface of the button portion, while a second end of each of the arcuate portions is a free end i.e. each of the pair of arcuate portion comprises a free second end. The free second end of each of the arcuate portions faces each other, and a circumferential gap exists between the free second ends of the arcuate portions. The pair of arcuate portions of the button member is configured to be detachably fitted around the tubular projection, more particularly, around the conical portion of the tubular projection of the inner sleeve. Furthermore, the pair of arcuate portions of the button member includes at least three grip grooves located near the free second ends of the pair of arcuate portions. More particularly, an outer surface of the first arcuate portion includes a first grip groove near its free second end, and an outer surface of the second arcuate portion includes a third grip groove near its free second end. A second grip groove is a discontinuous groove which is partially formed on the first arcuate portion and partially on the second arcuate portion on their respective inner surfaces at the free second end portions, separated by the circumferential gap.

According to yet another aspect of the present disclosure, the sliding member is completely housed inside the outer shell of the base assembly and is slidable within the outer shell. The sliding member comprises a top flat wall and an annular skirt extending downward from a lower surface of the top flat wall of the sliding member. Further, at least one slide groove is formed in the top flat wall of the sliding member at a periphery of the top flat wall of the sliding member. The at least one slide groove of the sliding member is configured to engage a corresponding slide guide protrusion formed on the inner surface at a lower portion of outer shell to guide the sliding member to slide in an axial direction by a predetermined interval within the outer shell of the base assembly.

In a preferred embodiment, the sliding member has four slide grooves and the outer shell comprises corresponding four slide guide protrusions so that stability during a sliding movement may be achieved. However, in various embodiments, the number of slide grooves and slide guide protrusions may be more or less than four.

According to yet another aspect of the present disclosure, the base assembly houses the spring which biases the sliding member in an upward direction and forces the sliding member to slide upward when the spring expands on release of a compression force on it. The spring extends between the inner surface of the bottom wall of the outer shell and the annular skirt of the sliding member.

According to yet another aspect of the present disclosure, base assembly houses the limiting member with the cavity of the outer shell. The limiting member is coupled to the inner surface of the outer shell immediately below the step in the outer shell. The limiting member includes at least a coupling protrusion on an outer surface of the limiting member that snap fits into a corresponding coupling groove provided on the inner surface of the sidewall of the outer shell to secure the limiting member to the outer shell of the base assembly.

According to yet another aspect of the present disclosure, the limiting member has an annular ring like structure, and comprises at least three grip projections namely a first grip projection, a second grip projection and a third grip projection, that extend downwardly from a lower end of the limiting member. The limiting member further includes a concave cut out on the outer surface of the limiting member substantially opposite the at least three grip projections. A first grip projection and a third grip projection flush with the outer surface of the limiting member while the second grip projection flush with an inner surface of the limiting member. The limiting member further includes a positioning groove that extends in axially on the outer surface of the limiting member opposite the second grip projection of the limiting member.

According to an aspect of the present disclosure, the limiting member functions to hold the button member in an axially fixed position inside the outer shell of the base assembly. Further, the button member is mounted below the limiting member inside the outer shell of the base assembly. The at least three grip grooves of the pair of arcuate portions of button member are configured to receive the corresponding at least three grip projections of the limiting member to couple the button member to the limiting member, and wherein at least three grip grooves of the pair of arcuate portions of button member have widths into which at least three grip projections of the limiting member fit. More particularly, the first grip projection and a third grip projection of the limiting member are received respectively in the first grip groove and the third grip groove formed on the outer surface of the arcuate portions of the button member. The second grip projection of the limiting member is received in the second grip groove formed partially on the inner surfaces of the arcuate portions of the button member. Thus, the button member is firmly gripped by the at least three grip projections of the limiting member.

According to yet another aspect of the present disclosure, the inner surface of the sidewall of the outer shell of the base assembly comprises a longitudinal positioning rib that extends from the bottom wall of the outer shell up to the inner step of the outer shell along the sidewall of the outer shell. The positioning longitudinal rib is provided to orient the position of the limiting member within the cavity of the outer shell. Thus, the longitudinal positioning rib engages the positioning groove of the limiting member to orient the limiting member such that the grip projections of the limiting member circumferentially oppose the aperture of the outer shell, and the concave cutout of the limiting member aligns with the aperture of the outer shell. Similarly, the positioning longitudinal rib also orients the button member properly during assembling by engaging between the corresponding gap between the arcuate portions of the button member.

The free second end portions of the arcuate portions of the button member are firmly sandwiched or abut between the second grip projection of the limiting member and the sidewall of the outer shell which increases the installation stability of the button member and also ensures that the button member does not shift axially when the button portion is pressed. In other words, the spring bias the sliding member to slide and push the refill cartridge in an upward discharge position so that the refill cartridge is released from the base assembly.

According to an aspect of the present disclosure, the lower ends of the at least three grip projections of the limiting member define an upper slide limit for the sliding member as it limits further an upward travel movement of the sliding member by abutting the top flat wall of the sliding member. The limiting member thus also prevents the sliding member from getting out of the outer shell by abutting against the top flat wall of the sliding member when the sliding member slides upward.

According to another aspect of the present disclosure, the refill cartridge is inserted into the outer shell of the base assembly, preferably through the opening of the outer shell. On inserting the refill cartridge, the tubular projection of the inner sleeve is received in the cavity of the outer shell, and wherein the pair of arcuate portions of the button member pass over the cylindrical rim portion of the tubular projection of the inner sleeve and engage with the conical portion of the tubular projection which is stepped in from the cylindrical rim portion, thereby preventing the refill cartridge from being pulled out from grip of the pair of arcuate portions of the button member. The button portion of the button member acts as a disengaging means attached with the pair of arcuate portions. By pushing in the button portion, the pair of arcuate portions disengages from the tubular projection of the inner sleeve because of elastic deformation of the pair of arcuate portions. In various embodiments, the button portion and the pair of arcuate portions may or may not be integrally attached.

In a rested state, the pair of arcuate portions form a substantially oval or fusiform cross-section with its major axis substantially larger than a diameter of the cylindrical rim portion of the tubular projection of the inner sleeve and its minor axis is smaller than the diameter of the cylindrical rim portion. When the pair of arcuate portions is elastically deformed by pressing the button portion the pair of arcuate portions deform to attain a substantially circular shape, thus an inner diameter formed by the pair of arcuate portions becomes larger than the diameter of the cylindrical rim portion of the tubular projection of the inner sleeve.

The pair of arcuate portions and the button portion may be made of a resilient material such as resilient metal or a hard and elastic synthetic resin. The button portion is slidably received in the radial aperture formed in the at least one sidewall of the outer shell of the base assembly.

In an unstressed state, the pair of arcuate portions engages the conical portion of the tubular projection of the inner sleeve, keeping the refill cartridge from coming off the outer shell of the base assembly. During locking the refill cartridge with the base assembly, a lower end of the refill cartridge moves the sliding member downwardly to compress the spring. When replacing the refill cartridge, the button portion is pushed in by pressing, the pair of arcuate portions, is compressed from both ends of its major axis and deformed into a substantially circular shape having a larger diameter than the diameter of the cylindrical rim portion of the tubular projection of the inner sleeve. In this state, the pair of arcuate portions, disengages from the conical portion of the tubular projection of the inner sleeve. In other words, when the button portion is pressed so that the pair of arcuate portions, is outwardly expanded and elastically deformed, and the pair of arcuate portions is no longer crimped on the conical portion of the tubular projection of the inner sleeve. When the button portion is pressed and the refill cartridge is in a normally removable position, the spring expands causing the sliding member to slide and push the refill cartridge to assume an extended position thereby the refill cartridge is forcefully ejected from the outer shell of the base assembly. The refill cartridge pops out in a vertical direction providing a visual indication to a user that the refill cartridge is now unlocked from the base assembly and thus the refill cartridge may be easily and quickly removed from the base assembly. In other words, the refill cartridge can be removed from the base assembly simply by pushing in the button portion with one finger. Sliding of the sliding member stops in upward direction when it abuts a lower end of the limiting member. A new refill cartridge now can be inserted in the base assembly. Further, when the finger is released from the button portion, the pair of arcuate portions return to their original oval shape by their own resiliency, restoring their original shapes, and are crimped on the conical portion of the new refill cartridge again, thereby fixing the new refill cartridge.

In an embodiment according to a second embodiment of the present disclosure, a refillable container may include a different mechanism for propelling and retracting the stick type cosmetic or skincare product than disclosed for the first embodiment. According to an aspect of the second embodiment, the refillable container comprises a base assembly, a refill cartridge, and a cap. The base assembly is configured to house and detachably secure at least a lower portion of the refill cartridge. The refill cartridge includes a lifting member, a sleeve member, and a driving member. The base assembly comprises an outer shell and a button member. The rotation of the base member rotates the driving member of the refill cartridge, which in turn contributes to the elevating and lowering operation of the lifting member for exposing and hiding the stick product within the sleeve member. The button member that can be pressed by a user to eject the refill cartridge from the base assembly of the refillable container.

According to an aspect of the second embodiment, the cap is detachably attached to the base assembly by snap-fitment. In alternative embodiments, however, the cap and the outer shell of the base assembly may be removably secured to each other by any other method known in the art.

According to an aspect of the second embodiment, the refill cartridge assembly comes with a temporary dust cover that may be removed after the refill cartridge is assembled with the base assembly. The purpose of the temporary dust cover is to prevent the stick product from being exposed to the external environment and getting contaminated. The temporary dust cover achieves this by covering an upper open end of the sleeve member of the refill cartridge.

According to another aspect of the second embodiment, the outer shell of the base assembly is elongated along a longitudinal direction and includes an upper open end and a closed bottom end. The outer shell further includes at least one sidewall defining an opening at the upper open end of the outer shell and a bottom wall defining the closed bottom end of the outer shell. The sidewall and the bottom wall of the outer shell define the cavity for receiving the refill cartridge. Further, the outer shell has an aperture on the sidewall for receiving and accommodating at least a portion of the button member therein.

According to another aspect of the second embodiment, an annular inner skirt is located within the cavity of the outer shell, the annular inner skirt extends upwards from an inner surface of the bottom wall of the outer shell. The annular inner skirt and the sidewall of the outer shell are aligned coaxially. The annular inner skirt is situated at a radial distance inward from the sidewall of the outer shell. On an upper free edge of the annular inner skirt, there are provided two mounting protrusions. The two mounting protrusions are circumferentially spaced from each other at least 180 degrees apart. Furthermore, there are provided two longitudinal ribs on an inner surface of the sidewall of the outer shell. The two longitudinal ribs extend from a bottom end of the sidewall up to a certain length of the sidewall. The two longitudinal ribs help in positioning and supporting a portion of the button member of the base assembly. The longitudinal ribs are circumferentially spaced apart on the sidewall and are located substantially opposite the aperture of the sidewall of the outer shell. Each of the two longitudinal ribs tapers slightly towards its upper end.

According to yet another aspect of the second embodiment, the button member comprises a button portion and a gripping portion. The gripping portion comprises a pair of arcuate portions opposite each other in a circumferential direction. When the button member is assembled to the outer shell of the base assembly, the button portion is exposed to an outer side through the aperture formed in the outer shell of the base assembly, while the pair of arcuate portions are located inside the cavity of the outer shell. The pair of arcuate portions of the button member are elastically deformable. Further, a first end of each of the arcuate portions is connected to an inner surface of the button portion, while a second end of each of the arcuate portions is a free second end. The free second end of each of the arcuate portions faces each other, and a circumferential gap exists between the free second ends of the arcuate portions. The pair of arcuate portions of the button member are configured to be detachably fitted around the driving member. Further, the pair of arcuate portions of the button member include at least two grip grooves near the free second ends of the pair of arcuate portions. More particularly, an outer surface of the first arcuate portion includes a first grip groove near its free second end, and an outer surface of the second arcuate portion includes a second grip groove near its free second end.

The two longitudinal ribs of the outer shell are configured to orient the position of the pair of arcuate portions of the button member within the cavity of the outer shell. Particularly, each of the two longitudinal ribs engages with one of the grip grooves to orient the button member such that the button member aligns with the aperture of the outer shell.

According to yet another aspect of the second embodiment, the lifting member of the refill cartridge includes a lifting rod of a certain length and a cosmetic cup formed on the upper portion of the lifting rod. The lifting rod has a hollow rectangular rod structure with two curved walls and two flat walls. The two curved walls are opposing each other, and the two flat walls are opposing each other. The flat walls are flat in the vertical direction. Screw threads are formed at the outer surface of the curved walls. Further, a stopper protrusion is formed at a lower end of each of the two flat walls of the lifting rod. The cosmetic cup for carrying a stick product includes a sidewall and a bottom wall with a central opening that communicates with the hollow interior of the lifting rod. The cosmetic cup includes a plurality of axial ribs for anchoring the stick product within the cosmetic cup. The central opening at the bottom wall enables the cosmetic stick product to be bottom filled into the cosmetic cup during a product molding process.

According to yet another aspect of the second embodiment, the driving member of the refill cartridge is configured to be inserted into the cavity of the outer shell and mounted on the annular inner skirt. This driving member is rotated by the rotation of the outer shell. The driving member is a hollow tubular body with a sidewall. A screw thread is formed on the inner surface of an upper portion of the sidewall of the driving member so as to engage the screw threads formed on the curved walls of the outer surface of the lifting member, when the lifting rod of the lifting member is accommodated inside the driving member. In a state where the lifting member is positioned inside the driving member, the lifting member is elevated by the rotation of the driving member.

According to yet another aspect of the second embodiment, the driving member includes two axial protrusions on an outer surface of the sidewall thereof. The two axial protrusions and circumferentially spaced part by 180 degrees on the sidewall. Each of the two axial protrusions extends from a bottom end of the sidewall up to at least $3/4^{th}$ of a length of the driving member. Each of the two axial protrusions includes a mounting groove. The two mounting grooves receive the two mounting protrusions of the annular inner skirt of the outer shell for mounting the driving member on the annular inner skirt in a non-rotatable and detachable manner. The upper ends of the two axial protrusions serve to support lower ends of the pair of arcuate portions by providing an abutment surface for the pair of arcuate portions. This abutment limits the possibility of a downward axial movement of the pair of arcuate portions.

According to yet another aspect of the second embodiment, the sleeve member of the refill cartridge has a sidewall with an open upper end and an open lower end. The sleeve member includes a rotation limiting part that contacts the lifting rod of the lifting member in order to prevent the lifting member from rotating. The rotation limiting part includes an inner transverse wall with an opening located inside the sleeve member. The cosmetic cup is housed inside the sleeve member on an upper side of the inner transverse wall. The inner transverse wall abuts a lower end of the cosmetic cup to limit a downward movement of the cosmetic cup. The opening has two opposing flat edges and two opposing curved edges with a curved shape in contact with the curved walls of the lifting member. In a state in which the lifting member is inserted into the rotation limiting part, the flat edges are in contact with the flat walls of the lifting rod, and the curved edges are in contact with the curved walls of the lifting rod. Accordingly, the lifting rod is not rotated, and the lifting rod is raised and lowered by the rotation of the driving member. However, the lifting rod passes through the opening of the rotation limiting part of the sleeve member while ascending and descending. As the driving member rotates, the lifting rod rises, but the stopper protrusion formed at the lower end of each of the two flat walls of the lifting rod is caught on the flat edges of the rotation limiting part, preventing a complete upward movement of the lifting rod in to upper portion of the sleeve member and preventing the possibility of disengagement of the lifting member with the driving member.

According to yet another aspect of the second embodiment, an annular groove on its outer surface at an upper portion of the sidewall. Further, an inner surface of the sleeve member includes at least one bead on an inner surface of the sidewall of the sleeve member below the rotation limiting part. When the driving member is received inside a lower portion of the sleeve member, the at least one bead of the sleeve member receives the annular groove of the driving member such that the driving member can rotate with respect to the sleeve member. In other words, when the driving member rotates, the sleeve member does not rotate with the driving member.

According to yet another aspect of the second embodiment, the refill cartridge is inserted into the outer shell of the base assembly, preferably through the opening of the outer shell. On inserting the refill cartridge, at least a lower portion of the sleeve member and the driving member are received in the cavity of the outer shell. The pair of arcuate portions, of the button member engage and grip the outer surface of the driving member. In a rested state, when the button is not pressed, the pair of arcuate portions, form a substantially oval or fusiform cross-section with a major axis and a minor axis. The minor axis is smaller than the diameter of the driving member which allows the pair of arcuate portions, to form a grip on the outer surface of the driving member and thus, keep the refill cartridge from coming off the outer shell of the base assembly.

In order to use the stick product in the refillable container of the second embodiment, the user must remove both the cap and the temporary dust cover. More particularly, during use, the user rotates the outer shell of the base assembly in a first direction with respect to the sleeve member, causing the driving member to rotate. The rotation of the driving member causes the lifting member to elevate, and thus, the cosmetic cup moves in an upward direction to expose the stick product from the opening at the open upper end of the sleeve member. After use, the user rotates the outer shell in a second direction opposite to the first direction, which causes the cosmetic cup to move in a downward direction and hide the cosmetic product in the sleeve member. Once the lifting member is lowered, the cap can be placed to cover the refillable container.

According to yet another aspect of the second embodiment, the refill cartridge is configured to be detachably received at least partially within the cavity of the outer shell of the base assembly such that the refill cartridge can be replaced when the stick product held within the refill cartridge is used up by a consumer. The base assembly and the cap are thus retained for re-use, while the refill cartridge can be replaced with a new one. The refill cartridge may be removed and replaced from the base assembly by pressing the button member provided in the base assembly. The button member is secured to the outer shell of the base assembly.

According to yet another aspect of the second embodiment, to replace the refill cartridge, when the pair of arcuate portions is elastically deformed by pressing the button portion, the pair of arcuate portions are compressed from both ends of its major axis and are deformed to attain a substantially circular shape having a larger diameter than the diameter of the driving member. In this state, the pair of arcuate portions disengages from the driving member of the refill cartridge. Thus, the button portion of the button member acts as a disengaging means attached to the pair of arcuate portions. In various embodiments, the button portion and the pair of arcuate portions may or may not be integrally attached. In other words, when the button portion is pressed so that the pair of arcuate portions are outwardly expanded and elastically deformed, and the pair of arcuate portions is no longer crimped on the driving member.

According to yet another aspect of the second embodiment, when the button portion is pressed and the refill cartridge is in a normally removable position, it can be pulled out by the user, and the refill cartridge may be easily and quickly removed from the base assembly. A new refill cartridge can be inserted into the base assembly. Further, when the finger is released from the button portion, the pair of arcuate portions, return to their original oval shape by their own resiliency, restoring their original shapes, and are crimped on the outer surface of the driving member of the new refill cartridge, thereby fixing the new refill cartridge.

The foregoing description, for purposes of explanation, has been described with reference to specific examples. However, the illustrative discussions above are not intended to be exhaustive or to limit the disclosure to the precise forms disclosed. Many modifications and variations are possible in view of the above teachings. The examples were chosen and described in order to best explain the principles of the disclosure and its practical applications, to thereby enable others skilled in the art to best utilize the disclosure and various examples with various modifications as may be suited to the particular use contemplated.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
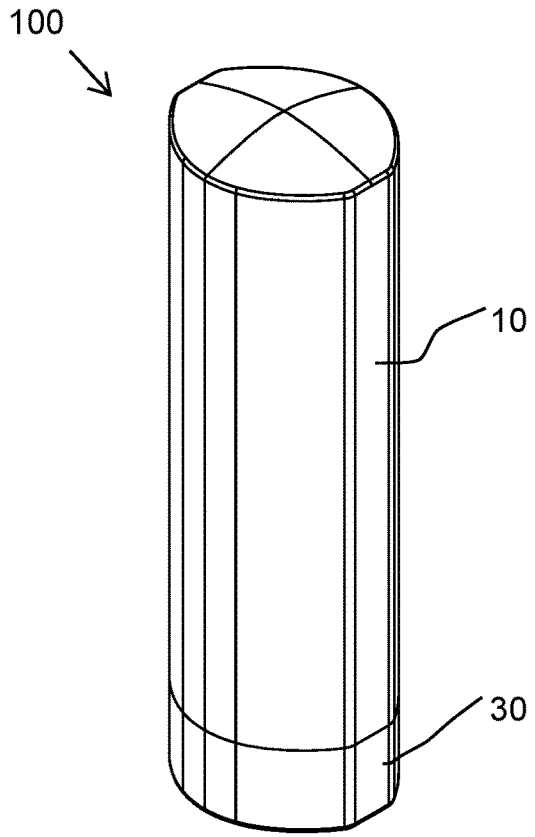
FIG. 1 is a perspective view of a refillable container in a closed state according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
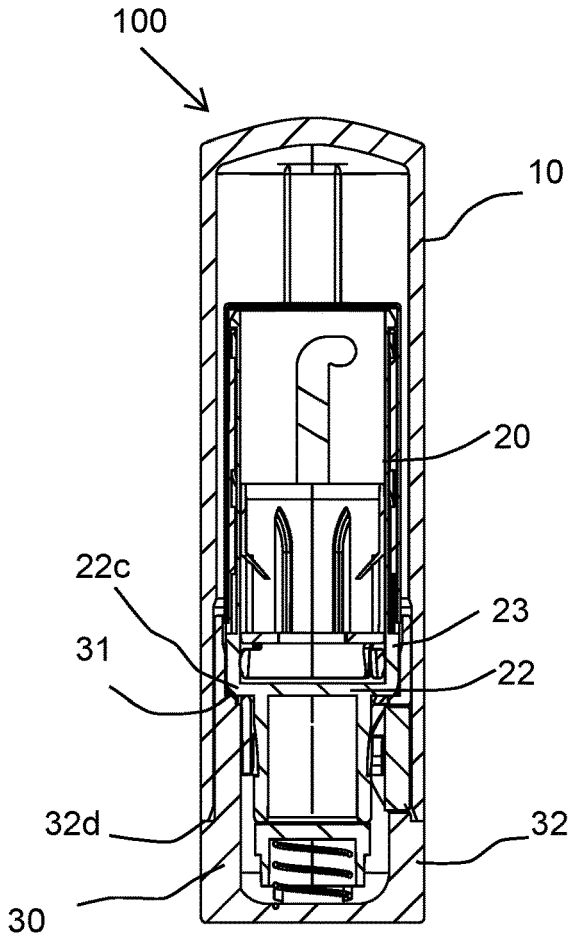
FIG. 2 is a longitudinal cross section of the refillable container of FIG. 1.
Figure 3:
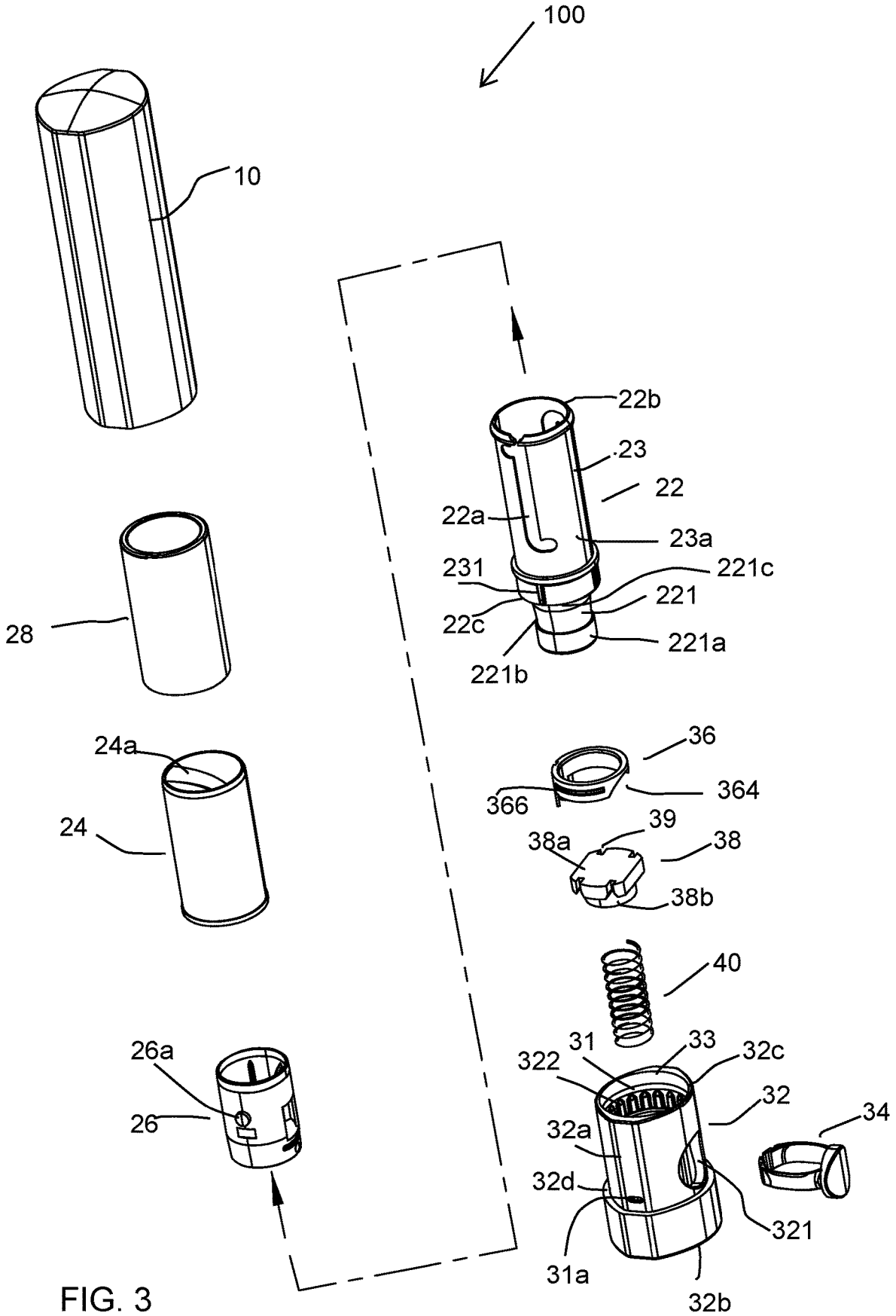
FIG. 3 is an exploded view of the refillable container of FIG. 1.

Referring now more in detail to the drawings, and more particularly to FIGS. 1 to 3 thereof, a refillable container 100 for a stick type cosmetic product (not shown) made in accordance with the present disclosure is shown to include a cap 10, a refill cartridge 20 and a base assembly 30. The stick type cosmetic product includes a solid or semi-solid cosmetic product such as antiperspirant or deodorant stick, lip balm, insect repellent, lipstick, concealer stick, foundation stick etc.

Figure 4:
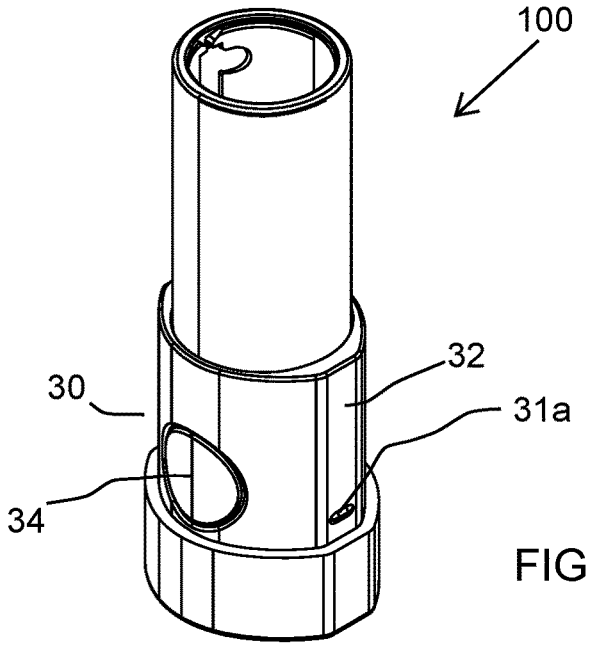
FIG. 4 is a perspective view of the refillable container of FIG. 1 in an open state without a cap.

The cap 10 is detachably attached to the base assembly 30. As seen in FIGS. 3 and 4, an outer shell 32 of the base assembly 30 includes features on its outer surface to detachably connect the cap 10. In the exemplary embodiment, as seen in FIG. 3, the outer shell 32 comprises at least one bead 31*a* on its outer surface and the cap 10 includes a corresponding groove (not visible) at its inner surface for a snap fitment. Further, the outer surface of the outer shell 32 comprises a stepped portion 32*d* and wherein the at least one bead 31*a* is positioned above the stepped portion 32*d*. When the cap 10 is put on the base assembly 20, a lower end of the cap 10 abuts the stepped portion 32*d*, see FIG. 2.

In alternative embodiments, the cap 10 and the outer shell 32 of the base assembly 30 may be removably secured to each other by any other method known in the art.

As shown in FIG. 1, a length of the cap 10 constitutes more than 75% of a length of the refillable container 100. However, in alternate embodiments, the length of the cap 10 may be greater or less than 75% of the length of the refillable container 100.

As seen in FIGS. 3 and 8-10, the base assembly 30 comprises the outer shell 32, a button member 34, a limiting member 36, a sliding member 38 and a spring 40. The outer shell 32 is a body with a sidewall 32*a*, a bottom wall 32*b*, an opening 32*c* at its distal end, and defining a cavity 33 therein.

Figure 5:
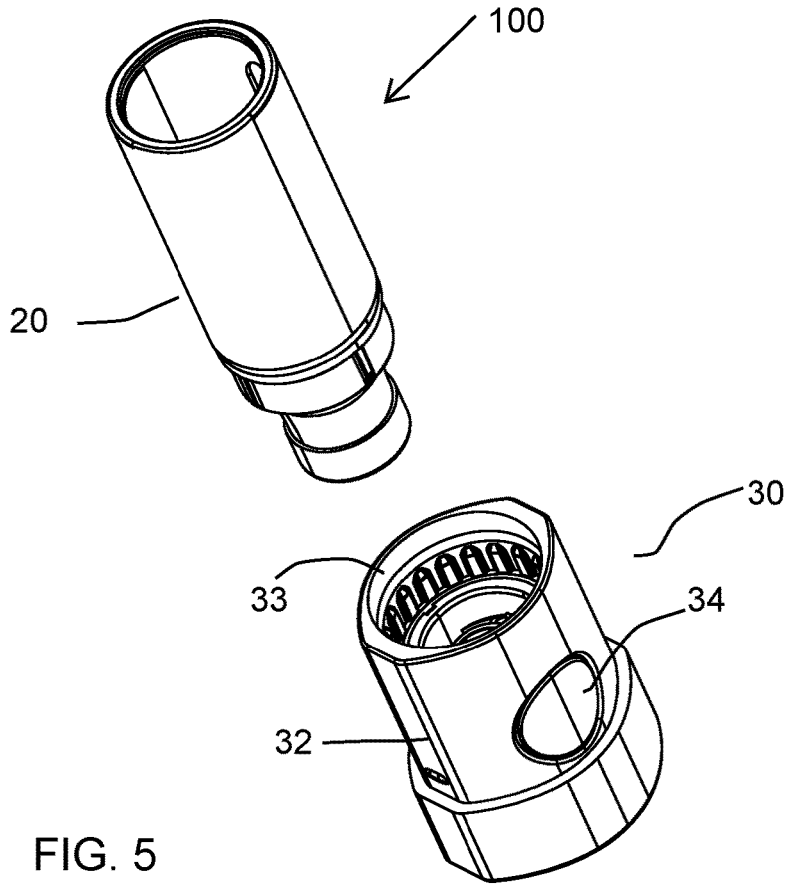
FIG. 5 is a perspective view showing a refill cartridge in a detached state from a base assembly of the refillable container of FIG. 4.

As shown in FIG. 5, the refill cartridge 20 is configured to be detachably received at least partially within the cavity 33 of the outer shell 32 of the base assembly 30 such that the refill cartridge 20 can be replaced when a cosmetic stick (not shown) held within the refill cartridge 20 is used up by a consumer. The base assembly 30 and the cap 10 is thus retained for re-use, while the refill cartridge 20 can be replaced with a new refill cartridge 20. The refill cartridge 20 may be removed and replaced from said base assembly 30 by pressing the button member 34 provided in the base assembly 30. The button member 34 is secured to the outer shell 32 of the base assembly 30.

Figure 6:
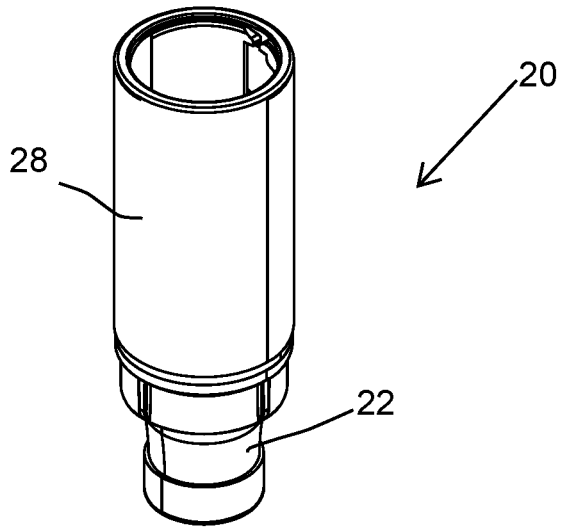
FIG. 6 is a perspective view of the refill cartridge of FIG. 5.
Figure 7:
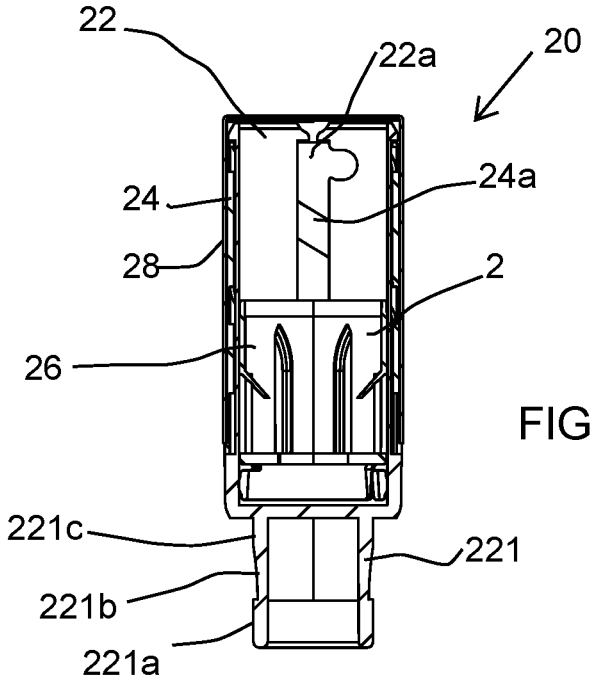
FIG. 7 is a cross sectional view of the refill cartridge of FIG. 6.

Further as shown in FIGS. 3, 6 and 7, the refill cartridge 20 includes an inner sleeve 22, a spiral cam sleeve 24, a carrier cup 26 and an outer sleeve 28. The inner sleeve 22 comprises an upper cylindrical portion 23 having a cylindrical sidewall 23*a*, an open top end 22*b*, a closed bottom wall 22*c*, and at least one longitudinal slot 22*a* in the cylindrical sidewall 23*a* thereof, see FIG. 3. Further, a tubular projection 221 extends downwardly from an outer surface of the closed bottom wall 22*c* of the upper cylindrical portion 23 of the inner sleeve 22. The tubular projection 221 of the inner sleeve 22 comprises a cylindrical distal portion 221*c*, a cylindrical rim portion 221*a* and a conical portion 221*b*. The conical portion 221*b* is stepped in from the cylindrical rim portion 221*a* and extends between the cylindrical distal portion 221*c* and the cylindrical rim portion 221*a*. The spiral cam sleeve 24 surrounds the upper cylindrical portion 23 of said inner sleeve 22 and is provided with a spiral groove 24*a* extending throughout a length of said spiral cam sleeve 24 on an inner surface of the spiral cam sleeve 24. The carrier cup 26 has an actuating pin 26*a* projecting laterally from an outer surface of said carrier cup 26. The carrier cup 26 is slidably movable inside said inner sleeve 22 and wherein the actuating pin 26*a* projects through the longitudinal slot 22*a* of the inner sleeve 22 engages with said spiral slot 24*a* of the spiral cam sleeve 24, whereby turning movement of the inner sleeve 22 relative to the spiral cam sleeve 24 propels the carrier cup 26 towards the open end 22*b* of the inner sleeve 22 or retract it therefrom. The outer sleeve 28 is tightly surrounding the spiral cam sleeve 24 and holding it in radially compressed condition whereby relative turning movement between the outer sleeve 28 and the spiral cam sleeve 24 is prevented.

After the refill cartridge 20 is assembled with the base assembly 30, a user holds the outer sleeve 28, and rotates the outer shell 32 of the base assembly 30, causing rotation of the inner sleeve 22, while the spiral cam sleeve 24 remains static. As a result, the actuating pin 26*a* of the carrier cup 26 moves in the spiral groove 24*a* of the spiral cam sleeve 24, driving the carrier cup 26 to move up or down in the inner sleeve 22.

More particularly, during use, the user rotates the outer shell 32 of the base assembly 30 in a first direction, the carrier cup 26 in an upward direction to expose the cosmetic product in the carrier cup 26 from the opening 22*b* at the distal end of the inner sleeve 22.

After use, the user rotates the outer shell 32 in a second direction opposite to the first direction, which causes the carrier cup 26 to move in a downward direction to hide the cosmetic product in the inner sleeve 22.

In alternate embodiments, other types of retractable operators may be used in place of the cam and slot arrangement which is explained in the present disclosure, such as vertical slide type or push type or any other mechanism known in the art.

Figure 9:
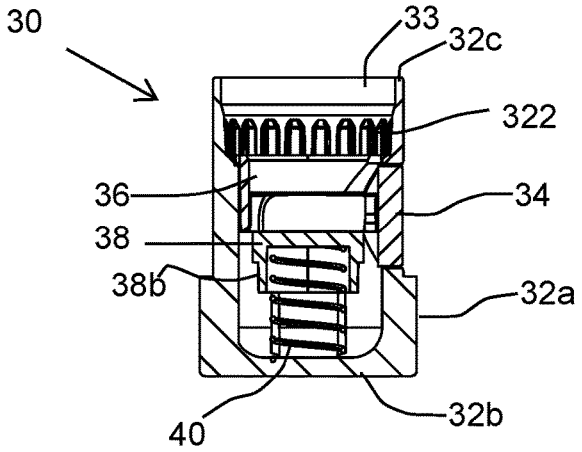
FIG. 9 is a cross-sectional view of the base assembly of FIG. 8.
Figure 10:
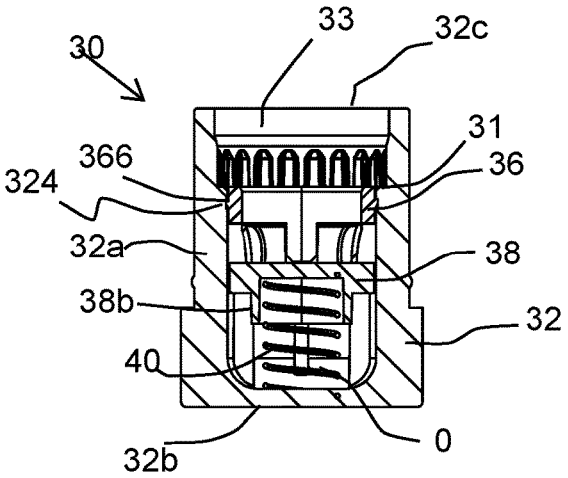
FIG. 10 is another cross-sectional view of the base assembly of FIG. 8.

Referring to FIGS. 3, 9 and 10, the outer shell 32 of the base assembly 30 comprises at least one sidewall 32*a* and the bottom wall 32*b*. An aperture 321 for receiving a portion of the button member 34 is formed in the outer shell 32 at one sidewall 32*a*. An inner surface of the sidewall 32*a* of the outer shell 32 comprises an inner step 31 near a distal end portion of the outer shell 32. A rotation lock portion is provided on the inner surface of the sidewall 32*a* of the outer shell 32 located above the inner step 31, and wherein the rotation lock portion comprises a plurality of first ribs 322, which is evenly distributed in a circumferential direction on the inner surface of the sidewall 32*a* of the outer shell 32. Further, as shown in FIG. 3, an annular cylindrical outer surface which is stepped out from a lower portion of the cylindrical sidewall 23*a* of the inner sleeve 22 comprises a plurality of second ribs 231 which are evenly distributed in a circumferential direction. The plurality of first ribs 322 of the outer shell 32 engages with the plurality of second ribs 231 of the inner sleeve 22 to prevent the inner sleeve 22 from rotation relative to the outer shell 32 of the base assembly 30.

Further, referring to FIG. 2, the outer shell 32 of the base assembly 30 is configured to receive the tubular projection 221 of the inner sleeve 22 of the refill cartridge 20 within the cavity 33 of the outer shell 32 below the inner step 31 of the outer shell 32, while the cylindrical upper portion 23 of the inner sleeve 22 is received within the cavity 33 above the inner step 31 such that the bottom wall 22*c* of the upper cylindrical portion 23 of the inner sleeve 22 rests on the inner step 31 of the outer shell 32.

Figure 8:
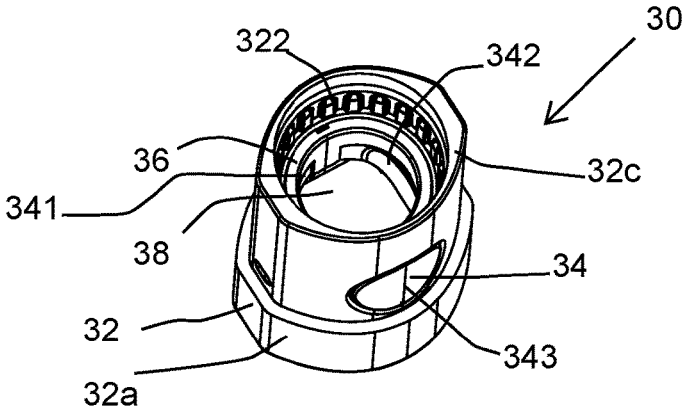
FIG. 8 is a perspective view of the base assembly of FIG. 5.
Figure 12:
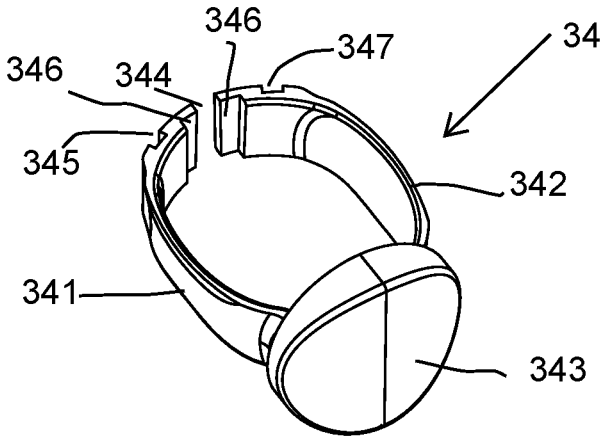
FIG. 12 is a perspective view of a button member of the refillable container of FIG. 3.
Figure 13:
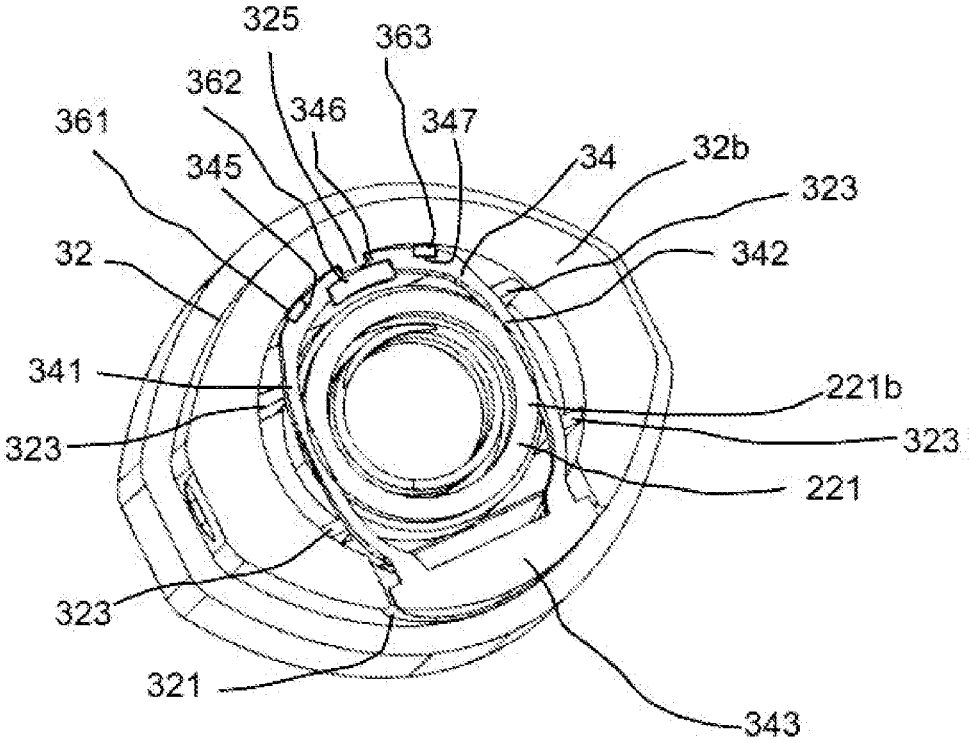
FIG. 13 is a transverse cross-sectional view of the refillable container of FIG. 4.

Referring to FIG. 12, a perspective view of the button member 34 is shown, the button member 34 comprises a button portion 343 and a gripping portion. The gripping portion comprises a pair of arcuate portions 341, 342 that are opposite to each other in a circumferential direction. When assembled to the outer shell 32 of the base assembly 30, the button portion 343 is exposed to an outer side through the aperture 321 formed in the outer shell 32 of the base assembly 30, while the pair of arcuate portions 341, 342 are located inside the cavity 33 of the outer shell 32, as shown in FIGS. 8 and 13. The pair of arcuate portions 341, 342 of the button member 34 are elastically deformable. Further, as shown in FIG. 12, a first end of each of the arcuate portions 341, 342 is connected to an inner surface of the button portion 343, while a second end of each of the arcuate portions 341, 342 is a free second end. The free second end of each of the arcuate portions 341, 342 faces each other and a circumferential gap 344 exists between the free second ends of the arcuate portions 341, 342. The pair of arcuate portions 341, 342 of the button member 34 is configured to be detachably fitted around the tubular projection 221, more particularly around the conical portion 221*b* of the tubular projection 221 of the inner sleeve 22, see FIG. 14. Further as shown in FIG. 12, the pair of arcuate portions 341, 342 of the button member 34 includes at least three grip grooves 345, 346, 347 near the free second ends of the pair of arcuate portions 341, 342. More particularly, an outer surface of the first arcuate portion 341 includes a first grip groove 345 near its free second end, and an outer surface of the second arcuate portion 342 includes a third grip groove 347 near its free second end. A second grip groove 346 is a discontinuous groove which is partially formed on the first arcuate portion 341 and partially on the second arcuate portion 342 on their respective inner surfaces at respective free second end portions, separated by the circumferential gap 344.

Referring back to FIG. 3, the sliding member 38 comprises a top flat wall 38*a* and an annular skirt 38*b* extending downward from a lower surface of the top flat wall 38*a* of the sliding member 38. Further, at least one slide groove 39 is formed in the top flat wall 38*a* of the sliding member 38 at a periphery of the top flat wall 38*a* of the sliding member 38. The sliding member 38 is completely housed in the outer shell 32 of the base assembly 30 and is slidable within the outer shell 32, see FIGS. 9 and 10. The at least one slide groove 39 is configured to accommodate a corresponding slide guide protrusion 323 formed on an inner surface at a lower portion of outer shell 32, refer FIG. 11. In other words, the slide guide protrusion 323 of the outer shell 32 is inserted in the corresponding slide groove 39 of the sliding member 38 to guide the sliding member 38 to slide in an axial direction by a predetermined interval within the outer shell 32 of the base assembly 30.

In exemplary embodiment, the sliding member 38 has four slide grooves 39, see FIG. 3 and the outer shell 32 comprises corresponding four slide guide protrusions 323 (see FIG. 13) so that stability during a sliding movement may be achieved. However, in various embodiments, the number of slide grooves and slide guide protrusions may be more or less than four.

Referring to FIGS. 9-10, the base assembly 30 further houses the spring 40 which is disposed in the outer shell 32 such that it extends between the inner surface of the bottom wall 32*b* of the outer shell 32 and the annular skirt 38*b* of the sliding member 38. The spring 40 in a compressed state biases the sliding member 38 in an upward direction and forces the sliding member 38 to slide upward when the spring 40 expands on release of a compression force on it.

Figure 11:
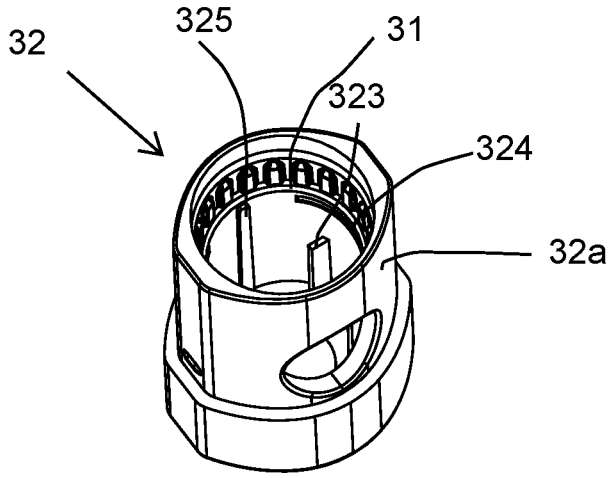
FIG. 11 is a perspective view of an outer shell of the base assembly of FIG. 8.

Referring to FIG. 3, the limiting member 36 of the base assembly 30 is provided inside the outer shell 32 which is coupled to the inner surface of the outer shell 32 at a distal portion thereof, more specifically, the limiting member 36 is coupled to the inner surface of the outer shell 32 that lies immediately below the step 31 in the outer shell 32. As seen in FIGS. 10 and 11, the limiting member 36 includes at least a coupling protrusion 366 (see FIGS. 3 and 15) on an outer surface of the limiting member 36 that snap fits into a corresponding coupling groove 324 of the outer shell 32 to secure the limiting member 36 to the outer shell 32 of the base assembly 30.

Figure 15:
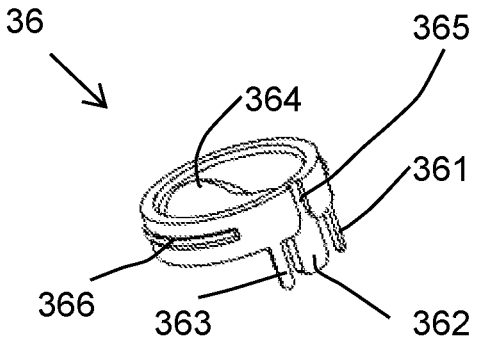
FIG. 15 is a perspective view of a limiting member of the refillable container of FIG. 3.
Figure 16:
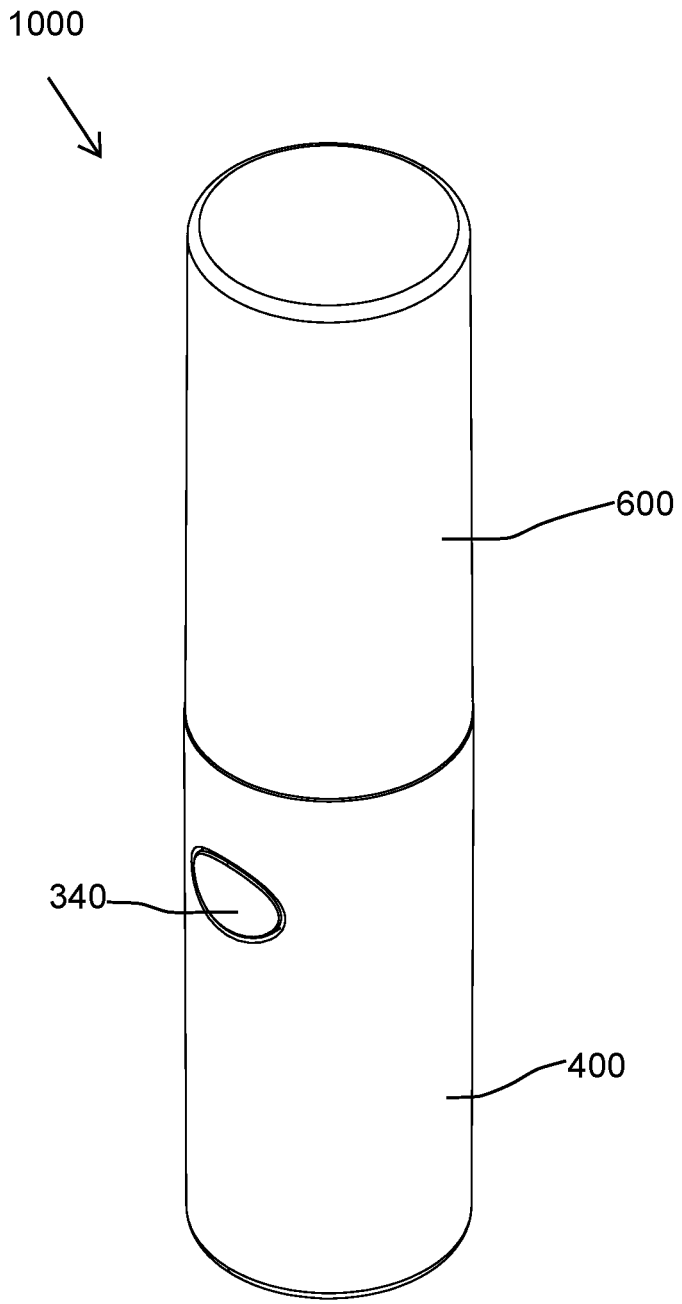
FIG. 16 is a perspective view of a refillable container in a closed state according to a second embodiment of the present disclosure.

As shown in FIGS. 3 and 15, the limiting member 36 has an annular ring like structure, and comprises at least three grip projections 361, 362, 363, namely a first grip projection 361, a second grip projection 362 and a third grip projection 363, that extend downwardly from a lower end of the annular ring of the limiting member 36. The limiting member 36 further includes a concave cut out 364 on the outer surface of the limiting member 36 substantially opposite the at least three grip projections 361, 362, 363. A first grip projection 361 and a third grip projection 363 flush with the outer surface of the limiting member 36 while the second grip projection 362 flush with an inner surface of the limiting member 36. The limiting member 36 further includes a positioning groove 365 that extends in axially on the outer surface of the limiting member 36 opposite the second grip projection 362 of the limiting member 36.

Figure 14:
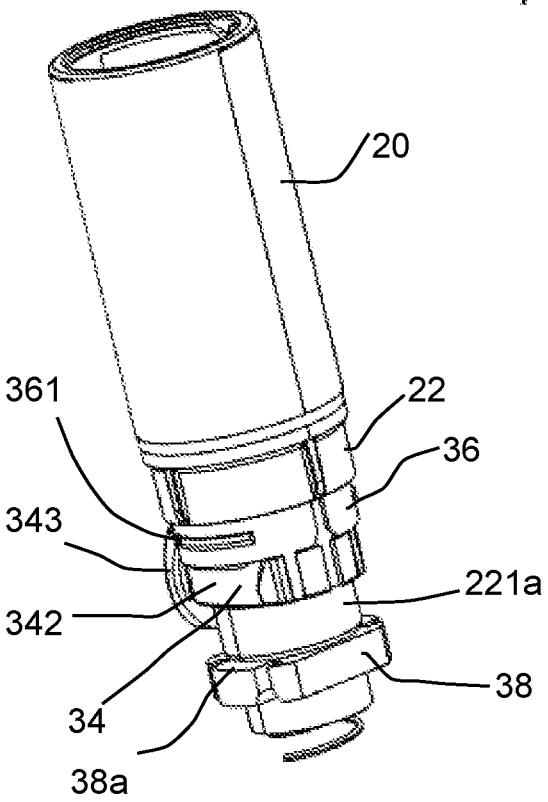
FIG. 14 is a perspective view of the refillable container of FIG. 4 with the outer shell removed.

According to an aspect of the present disclosure, the limiting member 36 functions to hold the button member 34 in an axially fixed position inside the outer shell 32 of the base assembly 30. As shown in FIGS. 9 and 10, the button member 34 is mounted below the limiting member 36 inside the outer shell 32 of the base assembly 30. As shown in FIGS. 13 and 14, the at least three grip grooves 345, 346, 347 of the pair of arcuate portions 341, 342 of button member 34 are configured to receive the corresponding at least three grip projections 361, 362, 363 of the limiting member 36 to couple the button member 34 to the limiting member 36, and wherein at least three grip grooves 345, 346, 347 of the pair of arcuate portions 341, 342 of button member 34 have widths into which at least three grip projections 361, 362, 363 of the limiting member 36 fit. More particularly, the first grip projection 361 and a third grip projection 363 of the limiting member 36 are received respectively in the first grip groove 345 and the third grip groove 347 formed on the outer surface of the arcuate portions 341, 342 of the button member 34. The second grip projection 346 of the limiting member 36 is received in the second grip groove 362 formed partially on the inner surfaces of the arcuate portions 341, 342 of the button member 34. Thus, the button member 34 is firmly gripped by the at least three grip projections 361, 362, 363 of the limiting member 36.

Referring to FIGS. 11 and 13, the inner surface of the sidewall 32*a* of the outer shell 32 of the base assembly 30 comprises a longitudinal positioning rib 325 that extends from the bottom wall 32*b* of the outer shell 32 up to the step 31 of the outer shell 32 along the sidewall 32*a* of the outer shell 32. The positioning longitudinal rib 325 is provided to orient the position of the limiting member 36 within the cavity 33 of the outer shell 32. Thus, the longitudinal positioning rib 325 engages the positioning groove 365 of the limiting member 36 to orient the limiting member 36 such that the grip projections 361, 362, 363 of the limiting member 36 circumferentially opposes the aperture 321 of the outer shell 32 and the concave cutout 364 of the limiting member 36 aligns with the aperture 321 of the outer shell 32. Similarly, the positioning longitudinal rib 325 also orient the button member 34 properly during assembling by engaging between the corresponding gap 344 between the arcuate portions 341, 342 of the button member 34, see FIG. 13.

As shown in FIG. 13, the free second end portions of the arcuate portions 341, 342 of the button member 34 are firmly sandwiched or abut between the second grip projection 362 of the limiting member 36 and the sidewall 32*a* of the outer shell 32 which increases the installation stability of the button member 34 and also ensures that the button member 34 does not shift axially when the button portion 343 is pressed. In other words, the spring 40 bias the sliding member 38 to slide and push the refill cartridge 20 in an upward discharge position so that the refill cartridge 20 is released from the base assembly 30.

According to an aspect of the present disclosure, the lower ends of the at least three grip projections 361, 362, 363 of the limiting member 36 define an upper slide limit for the sliding member 38 as it limits further an upward travel movement of the sliding member 38 by abutting the top flat wall 38*a* of the sliding member 38. The limiting member 36 thus also prevents the sliding member 38 from getting out of the outer shell 32 by abutting against the top flat wall 38*a* of the sliding member 38 when the sliding member 38 slides upward.

Referring to FIGS. 3, 13, and 14, the refill cartridge 20 is inserted into the outer shell 32 of the base assembly 30 preferably through the opening 32*c* of the outer shell 30. On inserting the refill cartridge 20, the tubular projection 221 of the inner sleeve 22 is received in the cavity 33 of the outer shell 32, and wherein the pair of arcuate portions 341, 342 of the button member 34 pass over a cylindrical rim portion 221*a* of the tubular projection 221 of the inner sleeve 22 and engage with the conical portion 221*b* of the tubular projection 221 which is stepped in from the cylindrical rim portion 221*a*, thereby preventing the refill cartridge 20 from being pulled out from grip of the pair of arcuate portions 341, 342 of the button member 34. The button portion 343 of the button member 34 acts as a disengaging means attached with the pair of arcuate portions 341, 342. By pushing in the button portion 343, the pair of arcuate portions 341, 342 disengages from the tubular projection 221 of the inner sleeve 22 because of elastic deformation of the pair of arcuate portions 341, 342. In various embodiments, the button portion 343 and the pair of arcuate portions 341, 342 may or may not be integrally attached.

In a rested state, the pair of arcuate portions 341, 342 form a substantially oval (see FIG. 12) or fusiform cross-section (not shown) with its major axis substantially larger than a diameter of the cylindrical rim portion 221*a* of the tubular projection 221 of the inner sleeve 22 and its minor axis is smaller than the diameter of the cylindrical rim portion 221*a*. When the pair of arcuate portions 341, 342 is elastically deformed by pressing the button portion 343, the pair of arcuate portions 341, 342 deform to attain a substantially circular shape, thus an inner diameter formed by the pair of arcuate portions 341, 342 becomes larger than the diameter of the cylindrical rim portion 221*a* of the tubular projection 221 of the inner sleeve 22.

The button portion 343 is slidably received in the radial aperture 321 formed in the at least one sidewall 32*a* of the outer shell 32 of the base assembly 30.

In an unstressed state shown in FIGS. 13 and 14, the pair of arcuate portions 341, 342 engages the conical portion 221*b* of the tubular projection 221 of the inner sleeve 22, keeping the refill cartridge 20 from coming off the outer shell 32 of the base assembly 30. When replacing the refill cartridge 20, the button portion 343 is pushed in by pressing, the pair of arcuate portions 341, 342 is compressed from both ends of its major axis and deformed into a substantially circular shape having a larger diameter than the diameter of the cylindrical rim portion 221*a* of the tubular projection 221 of the inner sleeve 22. In this state, the pair of arcuate portions 341, 342 disengages from the conical portion 221*b* of the tubular projection 221 of the inner sleeve 22. In other words, when the button portion 343 is pressed so that the pair of arcuate portions 341, 342 is outwardly expanded and elastically deformed, and the pair of arcuate portions 341, 342 is no longer crimped on the conical portion 221*b* of the tubular projection 221 of the inner sleeve 22. When the button portion 343 is pressed and the refill cartridge 20 is in a normally removable position, the spring 40 expands causing the sliding member 38 to slide and push the refill cartridge 20 to assume an extended position thereby the refill cartridge 20 is forcefully ejected from the outer shell 32 of the base assembly 30. The refill cartridge 20 pops out in a vertical direction providing a visual indication to a user that the refill cartridge 20 is now unlocked from the base assembly 30 and thus the refill cartridge 20 may be easily and quickly removed from the base assembly 30. In other words, the refill cartridge 20 can be removed from the base assembly 30 simply by pushing in the button portion 343 with one finger. Sliding of the sliding member 38 stops in upward direction when it abuts a lower end of the limiting member 36. A new refill cartridge 20 now can be inserted in the base assembly 30. Further, when the finger is released from the button portion 343, the pair of arcuate portions 341, 342 return to their original oval shape by own resiliency restoring to original shapes and are crimped on the conical portion 221*b* of the new refill cartridge 20 again, thereby fixing the new refill cartridge 20.

In various embodiments (not shown), the sliding member 38 and the spring 40 may be made integral.

FIGS. 16 to 33, show a refillable container 1000 for a stick type cosmetic or skincare product and components thereof made in accordance with a second embodiment of the present disclosure. As seen in FIGS. 16-19, the refillable container 1000 comprises a base assembly 400, a refill cartridge 500, and a cap 600. The base assembly 400 is configured to house and detachably secure at least a lower portion of the refill cartridge 500. The base assembly 400 includes a button member 440 that can be pressed by a user to eject the refill cartridge 500 from the base assembly 400 of the refillable container 1000.

Figure 17:
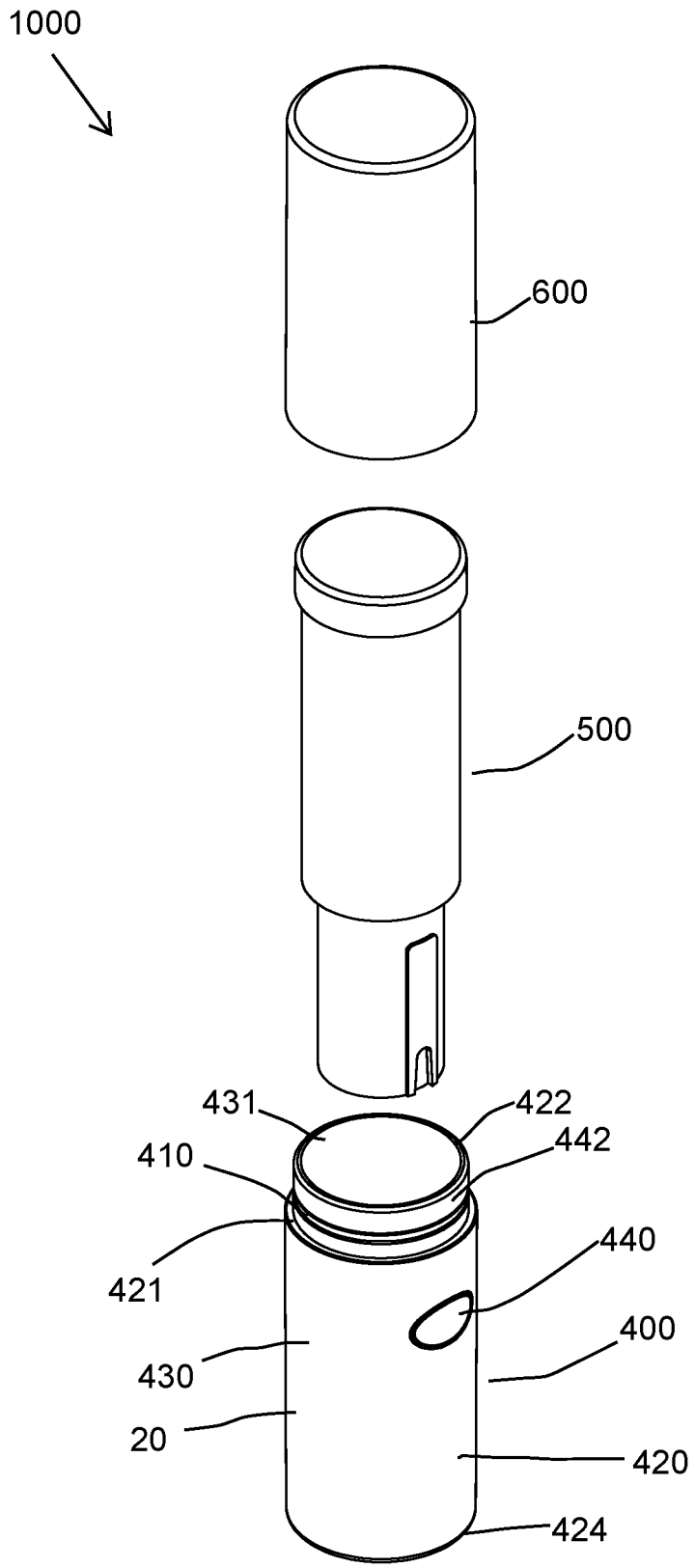
FIG. 17 is a partially exploded view of the refillable container of FIG. 16.
Figure 18:
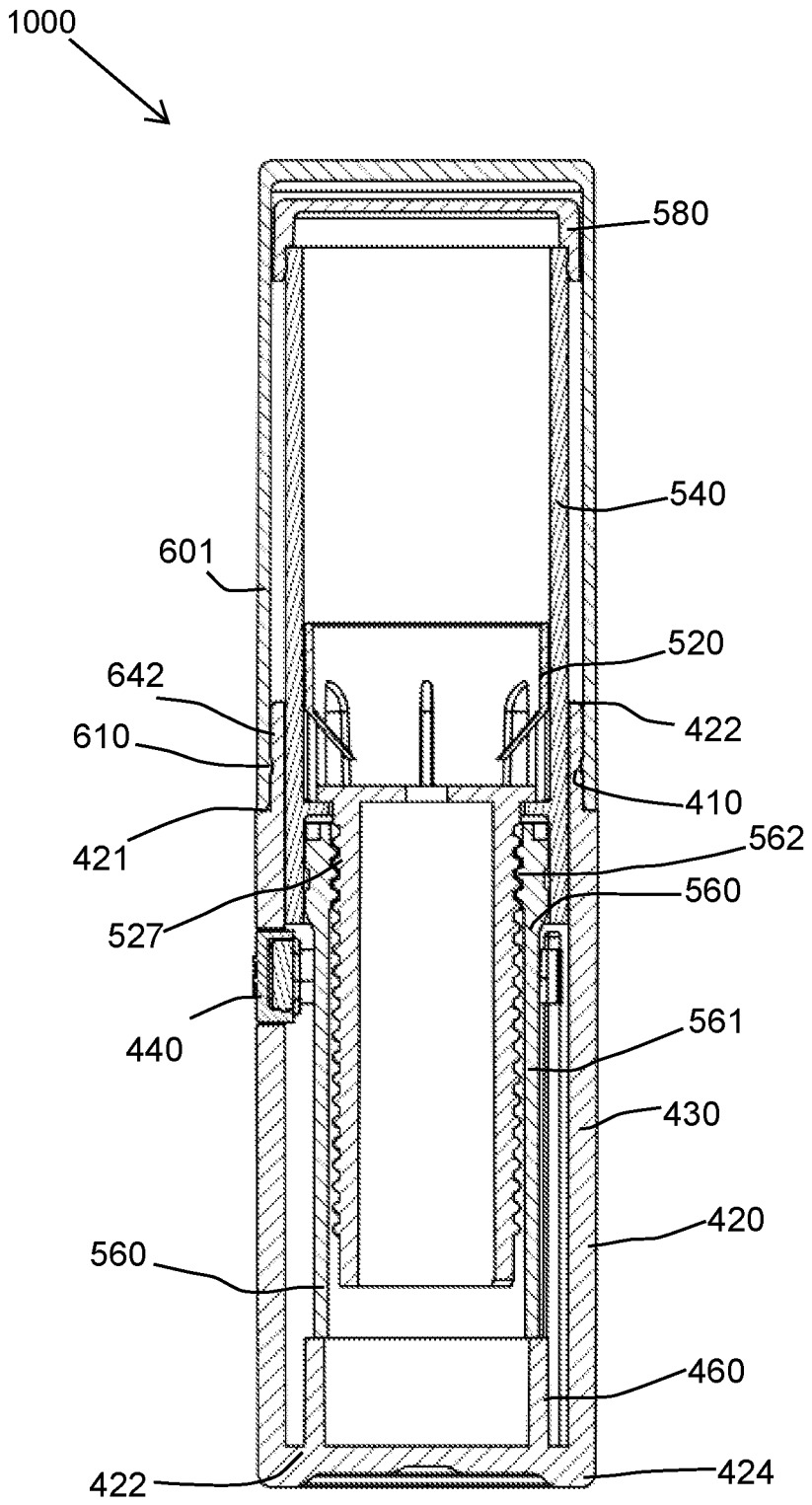
FIG. 18 is a longitudinal cross-sectional view of the refillable container of FIG. 16.

The cap 600 is detachably attached to the base assembly 400. In the exemplary embodiment, as seen in FIGS. 17 and 18, an outer shell 420 of the base assembly 400 comprises at least one groove 410 on its outer surface and the cap 600 includes a corresponding bead 610 on an inner surface of a sidewall 601 thereof for a snap fitment. More particularly, the outer surface of the outer shell 420 comprises a stepped portion 421 and wherein the at least one groove 410 is positioned above the stepped portion 421 which is formed as a neck 642 with a reduced diameter. When the cap 600 is put on the base assembly 400, a lower end of the cap 600 abuts the stepped portion 421, see FIG. 18.

In alternative embodiments, the cap 600 and the outer shell 420 of the base assembly 400 may be removably secured to each other by any other method known in the art.

Figure 19:
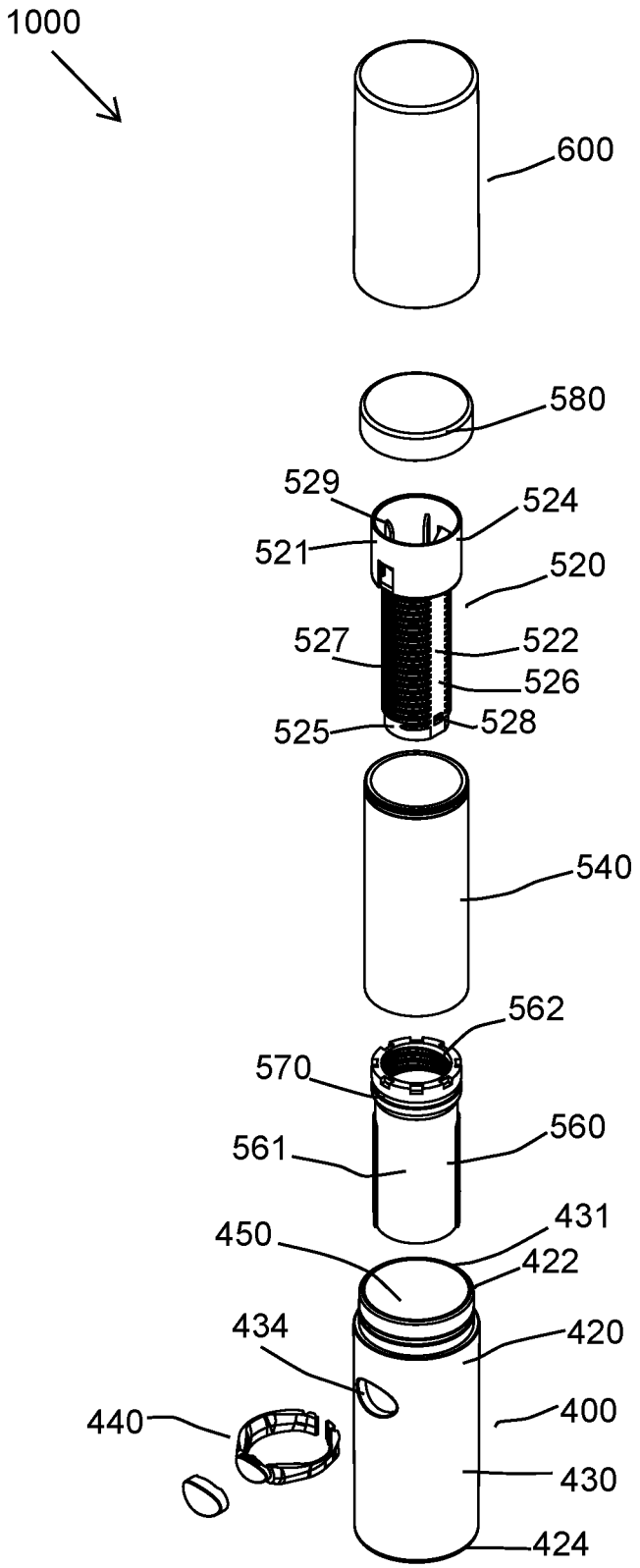
FIG. 19 is a fully exploded view of the refillable container of FIG. 16.
Figure 21:
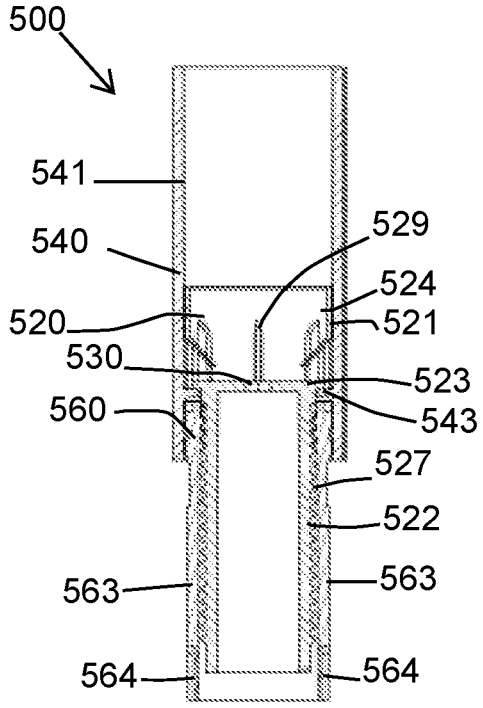
FIG. 21 is a longitudinal cross-sectional view of the refill cartridge of FIG. 20.

As shown in FIGS. 18, 19, and 21, the refill cartridge 500 includes a lifting member 520, a sleeve member 540, and a driving member 560. The refill cartridge assembly 500 also includes a temporary dust cover 580 that may be removed after the refill cartridge 500 is assembled with the base assembly 400. The purpose of the temporary dust cover 480 is to prevent the stick product from being exposed to the external environment and getting contaminated. The temporary dust cover 480 achieves this by covering an open end of the refill cartridge 500.

Referring to FIGS. 17 and 18, the base assembly 400 comprises the outer shell 420 and the button member 440. The rotation of the base member 440 rotates the driving member 560 of the refill cartridge 500, which in turn contributes to the elevating and lowering operation of the lifting member 520. The button member 440 is utilized for ejecting the refill cartridge 500 from the base member 420.

Referring to FIGS. 18, 19, 24, and 26, the outer shell 420 of the base assembly 400 is elongated along a longitudinal direction and includes an upper open end 422 and a closed bottom end 424. The outer shell 420 further includes at least one sidewall 430 defining an opening 431 at the upper open end 422 of the outer shell 420 and a bottom wall 432 defining the closed bottom end 424 of the outer shell 420. The sidewall 430 and the bottom wall 432 of the outer shell 420 define a cavity 450 for receiving the refill cartridge 500. Further, the outer shell 420 has an aperture 434 on the sidewall 430 for receiving and accommodating at least a portion of the button member 440 therein.

Figure 24:
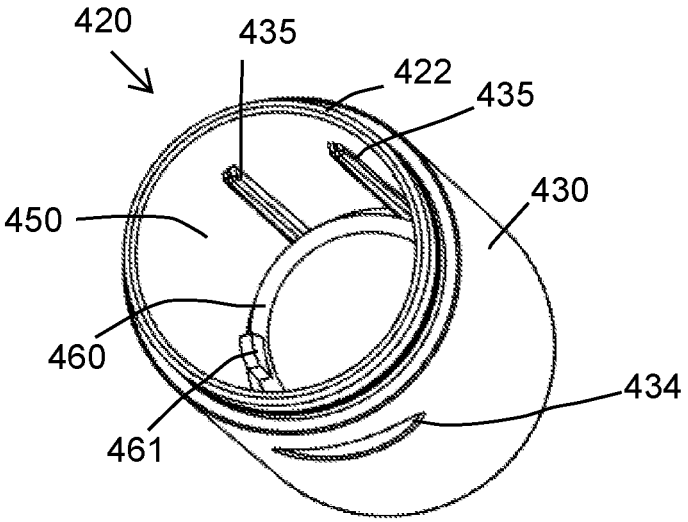
FIG. 24 is a top perspective view of an outer shell of the refillable container of FIG. 19.
Figure 26:
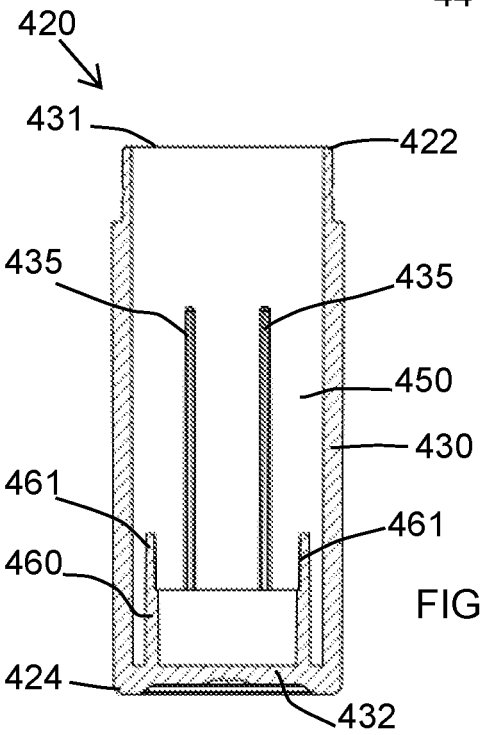
FIG. 26 is a longitudinal cross-sectional view of the outer shell of FIG. 24.

Referring to FIGS. 24 and 26, the cavity 450 of the outer shell 320 contains an annular inner skirt 460 that extends upwards from an inner surface of the bottom wall 432 of the outer shell 420. The annular inner skirt 460 and the sidewall 430 of the outer shell 420 are aligned coaxially. The annular inner skirt 460 is situated at a radial distance inward from the sidewall 430 of the outer shell 420. On an upper free edge of the annular inner skirt 460 there are provided two protrusions 461. The two protrusions 461 are circumferentially spaced from each other at least 180 degrees apart. Further, there are provided two longitudinal ribs 435 on an inner surface of the sidewall 430 of the outer shell 420. The two longitudinal ribs 435 extend from a bottom end of the sidewall 430 up to a certain length of the sidewall 430. The two longitudinal ribs 435 help in positioning and supporting a portion of the button member 440 of the base assembly 400. The longitudinal ribs 435 are circumferentially spaced on the sidewall 430 and are located substantially opposite the aperture 434 of the sidewall 430 of the outer shell 420. Each of the two longitudinal ribs 435 tapers slightly towards its upper end.

Figure 25:
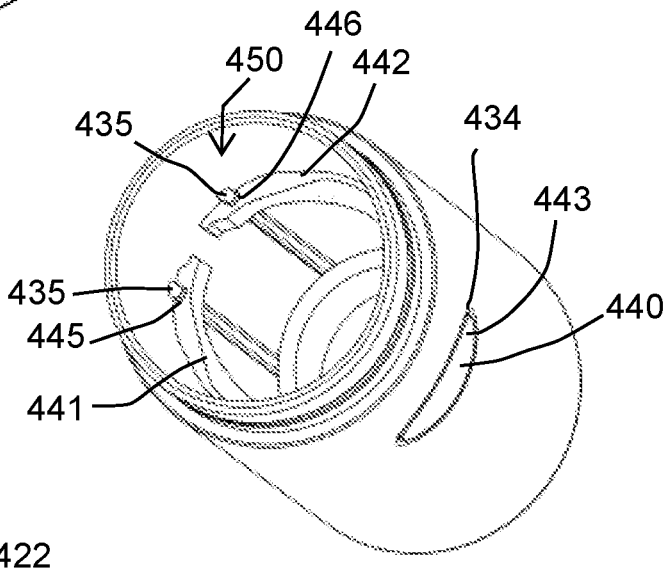
FIG. 25 is a top perspective view of a base assembly of the refillable container of FIG. 19.
Figure 27:
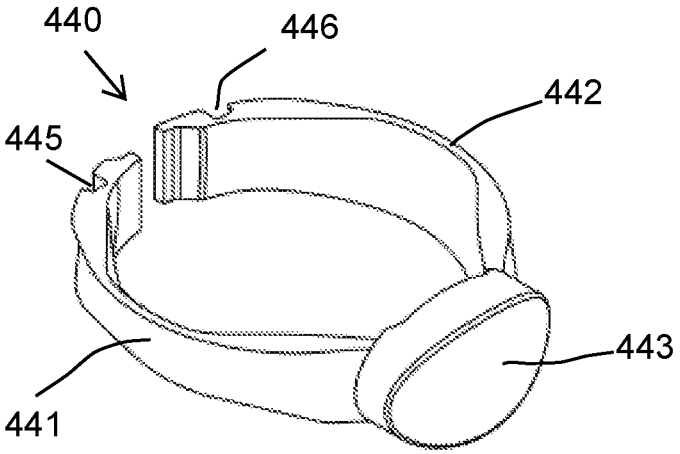
FIG. 27 is a front perspective view of a button member of the refillable container of FIG. 19.
Figure 28:
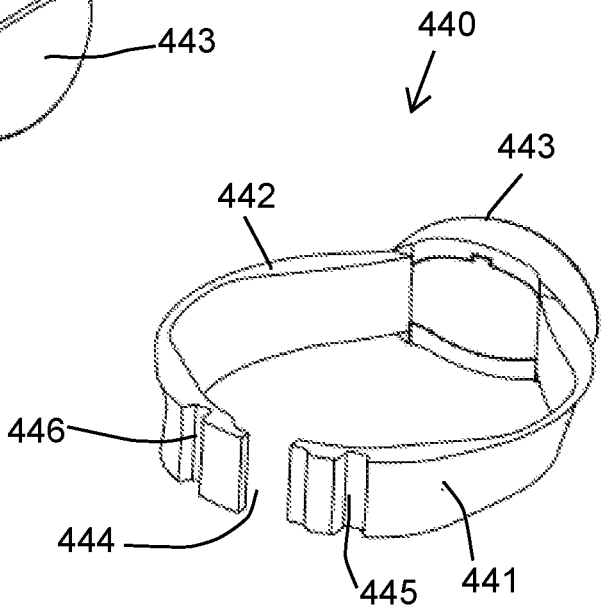
FIG. 28 is a back perspective view of the button member of FIG. 27.
Figure 29:
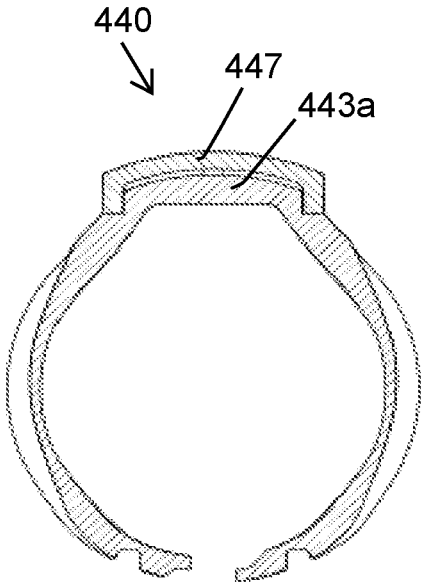
FIG. 29 is a transverse cross-sectional view of the button member of FIG. 27.

Referring to FIGS. 27 and 28, perspective views of the button member 440 are shown, the button member 440 comprises a button portion 343 and a gripping portion. The gripping portion comprises a pair of arcuate portions 441, 442 located opposite to each other in a circumferential direction. Referring to FIG. 25, the button member 440 when assembled to the outer shell 420 of the base assembly 400, the button portion 443 is exposed to an outer side through the aperture 434 formed in the outer shell 420 of the base assembly 400, while the pair of arcuate portions 341, 342 are located inside the cavity 450 of the outer shell 420, refer FIG. 25. The pair of arcuate portions 441, 442 of the button member 440 are elastically deformable. Further, as shown in FIG. 28, a first end of each of the arcuate portions 441, 442 is connected to an inner surface of the button portion 443, while a second end of each of the arcuate portions 441, 442 is a free second end. The free second end of each of the arcuate portions 441, 442 faces each other, and a circumferential gap 444 exists between the free second ends of the arcuate portions 441, 442. The pair of arcuate portions 441, 442 of the button member 440 are configured to be detachably fitted around the driving member 560, see FIG. 30. Further as shown in FIGS. 27 and 28, the pair of arcuate portions 441, 442 of the button member 440 include at least two grip grooves 445, 446 near the free second ends of the pair of arcuate portions 441, 442. More particularly, an outer surface of the first arcuate portion 441 includes a first grip groove 445 near its free second end, and an outer surface of the second arcuate portion 442 includes a second grip groove 446 near its free second end. Further, as seen in FIG. 29, the button portion 443 may be made in two parts joined together or as a single bi-injected part, including a button cover 447 and a button body 443*a*. The button cover 443 is made of a soft material and covers the button body 443*a*.

Referring to FIG. 25, the two longitudinal ribs 435 of the outer shell 420 orient the position of the pair of arcuate portions 441, 442 of the button member 440 within the cavity 450 of the outer shell 420. Particularly, each of the two longitudinal ribs 425 engages with one of the grip grooves 445, 446 to orient the button member 440 such that the button portion 443 aligns with the aperture 434 of the outer shell 420.

As seen in the FIGS. 19 and 21, the lifting member 520 includes a lifting rod 522 of a certain length and a cosmetic cup 524 formed on the upper portion of the lifting rod 522. The lifting rod 522 has a hollow structure with two curved walls 525 and two flat walls 526. The two curved walls 525 are opposing each other, and similarly, the two flat walls 526 are opposing each other. The flat walls 526 are flat in the vertical direction. Screw threads 527 are formed at the outer surface of the curved walls 525. Further, a stopper protrusion 528 is formed at a lower end of each of the two flat walls 526 of the lifting rod 522. The cosmetic cup 524 for carrying a stick type cosmetic product includes a sidewall 521, and a bottom wall 523 with a central opening 530 that communicates with the hollow structure of the lifting rod 522. The cosmetic cup 524 includes a plurality of axial ribs 529 for anchoring the stick type cosmetic product within the cosmetic cup 524. The central opening 530 at the bottom wall 523 enables the cosmetic stick product to be bottom filled into the cosmetic cup 524 during a product molding stage.

The driving member 560 is inserted into the outer shell 420 and is mounted on the annular inner skirt 460, see FIG. 18. This driving member 560 is rotated by the rotation of the outer shell 420. The annular inner skirt 460 has substantially same diameter as that of the lower portion of the driving member 560. The driving member 560 is a hollow tubular body with a sidewall 561. A screw thread 562 is formed on the inner surface of an upper portion of the driving member 560 so as to engage the screw threads 527 formed on the curved walls 525 of the outer surface of the lifting member 520, when the lifting rod 522 of the lifting member 520 is accommodated inside the driving member 560. In a state where the lifting member 520 is positioned inside the driving member 560, the lifting member 520 is elevated by the rotation of the driving member 560.

Figure 20:
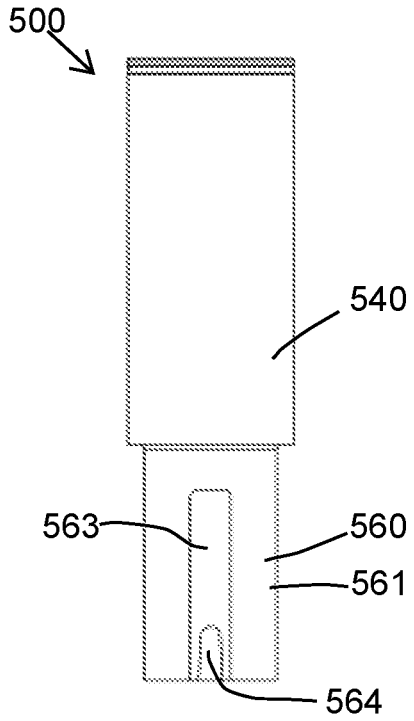
FIG. 20 is a front view of a refill cartridge of the refillable container of FIG. 17.
Figure 30:
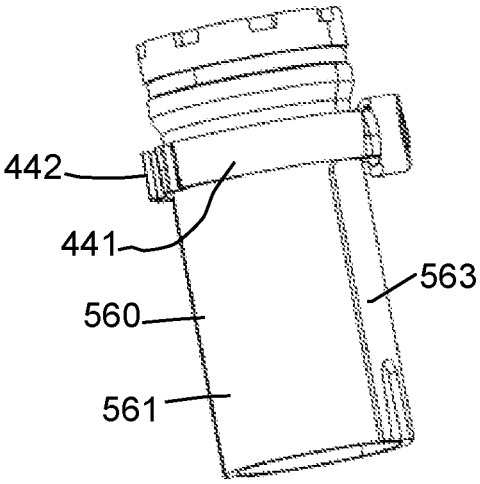
FIG. 30 is a perspective view of a driving member of the refillable container of FIG. 19, showing engagement of a button member on an outer surface thereof.
Figure 31:
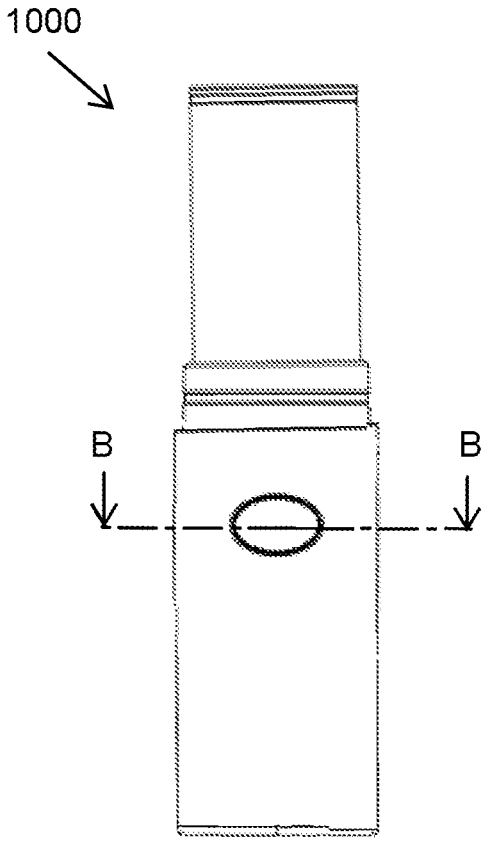
FIG. 31 is a front view of the refillable container of FIG. 16 with a cap removed.
Figure 32:
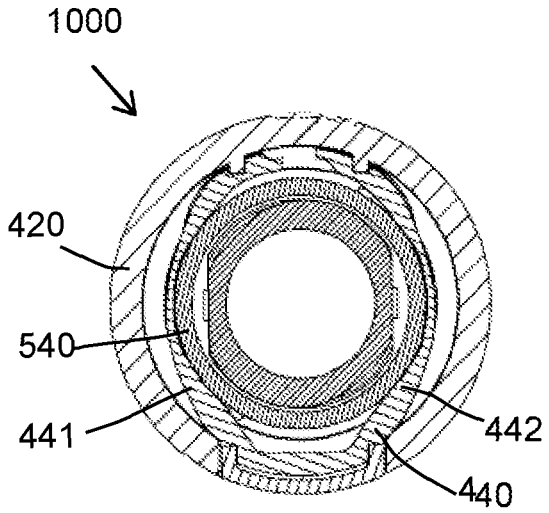
FIG. 32 is a transverse cross-section taken along a line B-B of the refillable container of FIG. 30, when a button member is in a rest state.

Referring to FIGS. 20 and 21, the driving member 560 includes two axial protrusions 563 on an outer surface of the sidewall 561 thereof. The two axial protrusions 563 and circumferentially spaced by 180 degrees apart on the sidewall 561. Each of the two axial protrusions 563 extends from a bottom end of the sidewall 561 up to at least ¾th of a length of the driving member 560. Each of the two axial protrusions 563 includes a mounting groove 564. Referring to FIGS. 20, 21, 24 and 26, the two mounting grooves 564 receive the two mounting protrusions 461 of the annular inner skirt 460 of the outer shell 420 for mounting the driving member 560 on the annular inner skirt 460 in a non-rotatable and detachable manner. The upper ends of the two axial protrusions 563 support to lower ends of the pair of arcuate portions 441, 442 by providing an abutment surface and thereby limiting possibility of a downward axial movement of the pair of arcuate portions 441, 442 (as seen in FIG. 30).

Figure 22:
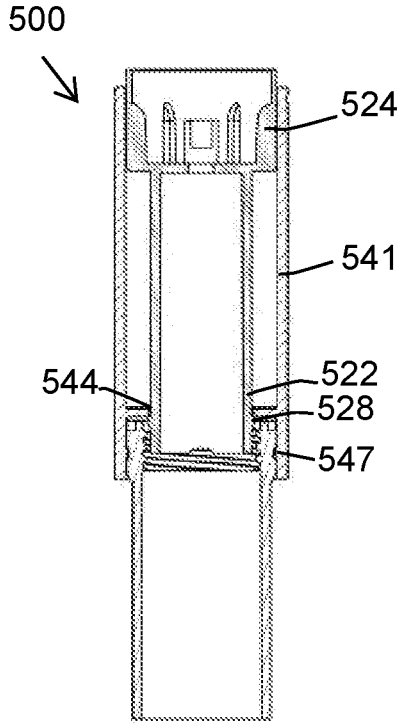
FIG. 22 is another longitudinal cross-sectional view of the refill cartridge of FIG. 20, showing a lifting member of the refill cartridge in an elevated position.
Figure 23:
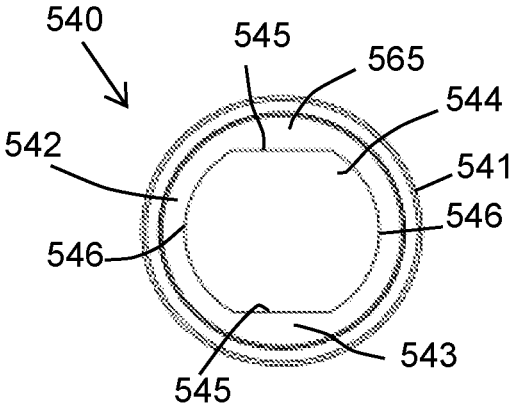
FIG. 23 is a top view of a sleeve member of the refillable container of FIG. 19.

Referring to FIGS. 21, 22 and 23, the sleeve member 540 has a sidewall 541 with an open upper end and an open lower end. The sleeve member 540 includes a rotation limiting part 542 that contacts the lifting rod 522 of the lifting member 520 in order to prevent the lifting member 520 from rotating. The rotation limiting part 542 includes an inner transverse wall 543 with an opening 544 located inside the sleeve member 540. The cosmetic cup 524 is housed inside the sleeve member 540 on an upper side of the inner transverse wall 543. The inner transverse wall 543 abuts a lower end of the cosmetic cup 524 to limit a downward movement of the cosmetic cup 524. The opening 544 has two opposing flat edges 545 and two opposing curved edges 546 with a curved shape in contact with the curved walls 525 of the lifting member 520. In a state in which the lifting member 520 is inserted into the rotation limiting part 542, the flat edges 545 are in contact with the flat walls 526 of the lifting rod 522, and the curved edges 546 are in contact with the curved walls 525 of the lifting rod 522. Accordingly, the lifting rod 522 is not rotated, and the lifting rod 522 is raised and lowered by the rotation of the driving member 560.

Referring to FIG. 22, the lifting rod 522 passes through the opening 544 of the rotation limiting part 542 of the sleeve member 540 while ascending and descending. As the driving member 560 rotates, the lifting rod 522 rises, but the stopper protrusion 528 formed at the lower end of each of the two flat walls 526 of the lifting rod 522 is caught on the flat edges 545 of the rotation limiting part 542, and preventing further upward movement of the lifting rod 522.

Further, as shown in FIG. 19, the driving member 560 includes an annular groove 570 on its outer surface at an upper portion of the sidewall 561. Further, an inner surface of the sleeve member 540 includes at least one bead 547 on an inner surface of the sidewall 541 of the sleeve member 540 below the rotation limiting part 542, see FIG. 22. When the driving member 560 is received inside a lower portion of the sleeve member 540, the at least one bead 542 of the sleeve member 540 receives the annular groove 570 of the driving member 560 to allow the driving member 560 to rotate with respect to the sleeve member 540. In other words, when the driving member 560 rotates, the sleeve member 540 does not rotate with the driving member 560.

The refill cartridge 500 is inserted into the outer shell 420 of the base assembly 400, preferably through the opening 431 of the outer shell 420. On inserting the refill cartridge 500, at least a lower portion of the sleeve member 540 and the driving member 560 are received in the cavity 540 of the outer shell 420, see FIG. 18. The pair of arcuate portions 441, 442 of the button member 440 engage and grip the outer surface of the driving member 540. In a rested state, when the button is not pressed, the pair of arcuate portions 441, 442 form a substantially oval or fusiform cross-section (see FIG. 32) with a major axis and a minor axis. The minor axis is smaller than the diameter of the driving member 540 which allows the pair of arcuate portions 441, 442 to form a grip on the outer surface of the driving member 540 and thus, keep the refill cartridge 20 from coming off the outer shell 420 of the base assembly 400.

In order to use the stick product in the refillable container 1000, the user must remove both the cap 600 and the temporary dust cover 580. More particularly, during use, the user rotates the outer shell 420 of the base assembly 400 in a first direction with respect to the sleeve member 540, causing the driving member 560 to rotate. The rotation of the driving member 560 causes the lifting member 520 to elevate, and thus, the cosmetic cup 524 moves in an upward direction to expose the stick product from the opening at the open upper end of the sleeve member 540. After use, the user rotates the outer shell 420 in a second direction opposite to the first direction, which causes the cosmetic cup 524 to move in a downward direction and hide the cosmetic product in the sleeve member 540. Once the lifting member is lowered, the cap 600 can be placed to cover the refillable container.

As shown in FIG. 18, the refill cartridge 1000 is configured to be detachably received at least partially within the cavity 450 of the outer shell 420 of the base assembly 400 such that the refill cartridge 500 can be replaced when the stick product held within the refill cartridge 500 is used up by a consumer. The base assembly 400 and the cap 600 are thus retained for re-use, while the refill cartridge 500 can be replaced with a new one. The refill cartridge 500 may be removed and replaced from the base assembly 400 by pressing the button member 440 provided in the base assembly 400. The button member 440 is secured to the outer shell of the base assembly.

Figure 33:
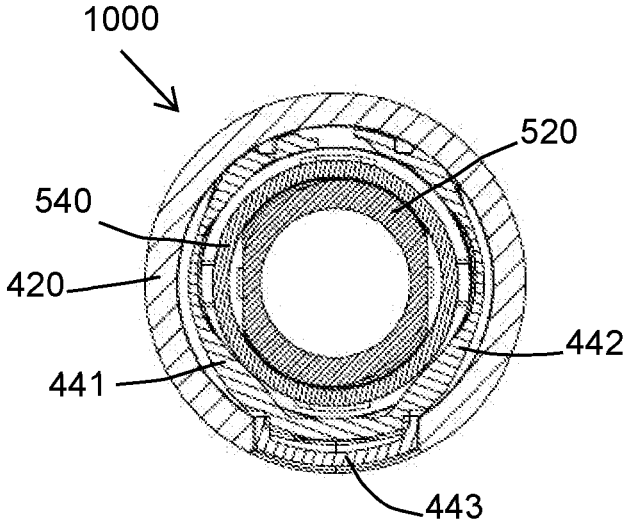
FIG. 33 is a transverse cross-section taken along a line B-B of the refillable container of FIG. 30, when the button member is in a pressed state.

To replace the refill cartridge 500, when the pair of arcuate portions 441, 442 is elastically deformed by pressing the button portion 443, the pair of arcuate portions 441, 442 is compressed from both ends of its major axis and deform to attain a substantially circular shape having a larger diameter than the diameter of the driving member 540 (see FIG. 33). In this state, the pair of arcuate portions 441, 442 disengage from the driving member 540 of the refill cartridge 500. Thus, the button portion 443 of the button member 440 acts as a disengaging means attached with the pair of arcuate portions 441, 442. In various embodiments, the button portion 443 and the pair of arcuate portions 441, 442 may or may not be integrally attached. In other words, when the button portion 443 is pressed so that the pair of arcuate portions 441, 442 is outwardly expanded and elastically deformed, and the pair of arcuate portions 441, 442 is no longer crimped on the driving member 540.

When the button portion 443 is pressed and the refill cartridge 500 is in a normally removable position, it can be pulled out by the user and the refill cartridge 500 may be easily and quickly removed from the base assembly 400. A new refill cartridge 500 can be inserted into the base assembly 400. Further, when the finger is released from the button portion 443, the pair of arcuate portions 441, 442 return to their original oval shape by their own resiliency, restoring their original shapes, and are crimped on the outer surface of the driving member 540 of the new refill cartridge 500, thereby fixing the new refill cartridge 500.

The components of the base assembly 30, 400, refill cartridge 20, 500 and the cap 10, 600 may be formed of any polymeric material such as acrylonitrile butyrene styrene, metal, wood or any other suitable material.

The pair of arcuate portions 341, 441, 342, 442 and the button portion 343, 434 may be made of a resilient material such as resilient metal or a hard and elastic synthetic resin It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A refillable container for a stick type cosmetic product, comprising:

a base assembly comprising an outer shell and a button member;

a cap detachably attached to the base assembly;

a refill cartridge comprising a lifting member, a sleeve member, and a driving member;

wherein the outer shell of the base assembly includes a sidewall, a bottom wall, an opening at a distal end of the outer shell, and defining a cavity therein;

wherein the button member of the base assembly comprises a button portion and a pair of arcuate portions;

wherein the pair of arcuate portions is opposite to each other in a circumferential direction, and wherein the pair of arcuate portions each includes a first end connected to the button portion and a free second end;

wherein the button portion is exposed to an outer side through an aperture formed in the sidewall of the outer shell of the base assembly, while the pair of arcuate portions are located inside the cavity of the outer shell;

wherein the refill cartridge is detachably received at least partially within the cavity of the outer shell of the base assembly;

wherein the driving member is inserted into the cavity of the outer shell and is mounted therein such that when the outer shell rotates the driving member also rotates;

wherein the lifting member includes a lifting rod and a cosmetic cup formed on the upper portion of the lifting rod;

wherein the cosmetic cup accommodates the stick type cosmetic product therein;

wherein screw threads are formed at the outer surface of the lifting rod;

wherein the sleeve member includes a sidewall and a rotation limiting part;

wherein the rotation limiting part includes an inner transverse wall having an opening;

wherein the driving member is received inside a lower portion of the sleeve member below the inner transverse wall such that the driving member can rotate with respect to the sleeve member;

wherein the lifting member is received inside the sleeve member such that the cosmetic cup is accommodated on an upper side of the inner transverse wall, and at least a portion of the lifting rod passes through the opening of the inner transverse wall and is received inside the driving member;

wherein a screw thread is formed on the inner surface of an upper portion of a sidewall of the driving member so as to engage the screw threads formed on the outer surface of the lifting rod;

wherein the rotation limiting part contacts the lifting rod of the lifting member in order to prevent the lifting member from rotating;

wherein the lifting rod is raised and lowered by the rotation of the driving member;

wherein the pair of arcuate portions of the button member detachably fit around the driving member of the refill cartridge to releasably lock the refill cartridge within the base assembly; and wherein when the button portion is pressed, the pair of arcuate portions of the button member elastically deform to release the refill cartridge from the base assembly.

2. The refillable container according to claim 1, wherein an annular inner skirt is located within the cavity of the outer shell, the annular inner skirt extends upwards from an inner surface of the bottom wall of the outer shell; wherein there are provided two mounting protrusions on an upper free edge of the annular inner skirt; wherein the driving member includes two axial protrusions on an outer surface of the sidewall thereof; and wherein each of the two axial protrusions includes a mounting groove configured to receive one of the two mounting protrusions of the annular inner skirt of the outer shell for mounting the driving member on the annular inner skirt in a non-rotatable and detachable manner.

3. The refillable container according to claim 2, wherein the annular inner skirt is situated at a radial distance inward from the sidewall of the outer shell.

4. The refillable container according to claim 2, wherein the two axial protrusions are circumferentially spaced part by 180 degrees on the sidewall of the driving member; and wherein each of the two axial protrusions extends from a bottom end of the sidewall up to at least $\frac{3}{4}^{th}$ of a length of the driving member.

5. The refillable container according to claim 2, wherein the two mounting protrusions are circumferentially spaced from each other at least 180 degrees apart.

6. The refillable container according to claim 2, wherein upper ends of the two axial protrusions serve to support lower ends of the pair of arcuate portions by providing an abutment surface for the pair of arcuate portions and limiting a downward axial movement of the pair of arcuate portions.

7. The refillable container according to claim 1, wherein the pair of arcuate portions of the button member includes a first grip groove on an outer surface of one arcuate portion of the pair of arcuate portions, and an outer surface of the other of the pair of arcuate portions includes a second grip groove; wherein two longitudinal ribs are provided on an inner surface of the sidewall of the outer shell; and wherein each of the two longitudinal ribs engages with one of the first grip groove and the second grip groove to orient the button member such that the button portion aligns with the aperture of the outer shell.

8. The refillable container according to claim 7, wherein the two longitudinal ribs extend from a bottom end of the sidewall up to a certain length of the sidewall; wherein the longitudinal ribs are circumferentially spaced apart on the sidewall and are located substantially opposite the aperture of the sidewall of the outer shell.

9. The refillable container according to claim 1, wherein the driving member includes an annular groove on its outer surface at an upper portion of the sidewall; wherein an inner surface of the sleeve member includes at least one bead on the sidewall of the sleeve member below the rotation limiting part; and wherein when the driving member is received inside a lower portion of the sleeve member, the at least one bead of the sleeve member receives the annular groove of the driving member such that the driving member can rotate with respect to the sleeve member.

10. The refillable container according to claim 1, wherein the refill cartridge assembly includes a temporary dust cover that is removed after the refill cartridge is assembled with the base assembly; and wherein the temporary dust cover covers an upper open end of the sleeve member of the refill cartridge.

11. The refillable container according to claim 1, wherein the lifting rod has a hollow rectangular rod structure with two curved walls and two flat walls; wherein the two curved walls are opposing each other, and the two flat walls are opposing each other; wherein the opening of the inner transverse wall has two opposing flat edges and two opposing curved edges; and wherein in a state in which the lifting member is inserted into the rotation limiting part, the two opposing flat edges are in contact with the two flat walls of the lifting rod, and the two opposing curved edges are in contact with the curved walls of the lifting rod.

12. The refillable container according to claim 11, wherein the screw threads are formed on the curved walls of the outer surface of the lifting member.

13. The refillable container according to claim 11, wherein a stopper protrusion is formed at a lower end of each of the two flat walls of the lifting rod; wherein when the driving member rotates, the lifting rod rises, the stopper protrusion formed at the lower end of each of the two flat walls of the lifting rod is caught on the corresponding flat edges of the rotation limiting part to prevent further upward movement of the lifting rod into an upper portion of the sleeve member.

14. A refillable container for a stick type cosmetic product, comprising:

a base assembly comprising an outer shell and a button member;

a cap detachably attached to the base assembly;

a refill cartridge comprising a lifting member, a sleeve member, and a driving member;

wherein the outer shell of the base assembly includes at least one sidewall, a bottom wall, an opening at a distal end of the outer shell, and defining a cavity therein;

wherein the button member of the base assembly comprises a button portion and a pair of arcuate portions;

wherein the button portion is exposed to an outer side through an aperture formed in the at least one sidewall of the outer shell of the base assembly, while the pair of arcuate portions are located inside the cavity of the outer shell;

wherein the refill cartridge is detachably received at least partially within the cavity of the outer shell of the base assembly;

wherein the driving member is inserted into the cavity of the outer shell and is mounted therein in a non-rotatable manner with respect to the outer shell such that when the outer shell rotates the driving member also rotates;

wherein the lifting member of the refill cartridge includes a lifting rod and a cosmetic cup formed on an upper portion of the lifting rod;

wherein the cosmetic cup accommodates the stick type cosmetic product therein;

wherein screw threads are formed at the outer surface of the lifting rod;

wherein at least an upper portion of the driving member is received inside a lower portion of the sleeve member such that the driving member can rotate with respect to the sleeve member;

wherein the cosmetic cup of the lifting member is received inside an upper side of the sleeve member and at least a portion of the lifting rod is accommodated inside the driving member located at the lower portion of the sleeve member;

wherein screw threads are formed on the inner surface of an upper portion of a sidewall of the driving member so as to engage the screw threads formed on the outer surface of the lifting rod;

wherein the lifting rod is raised and lowered by rotating the driving member;

wherein the pair of arcuate portions of the button member detachably fit around the driving member of the refill cartridge to releasably lock the refill cartridge within the base assembly; and wherein when the button portion is pressed, the pair of arcuate portions of the button member elastically deform to release the refill cartridge from the base assembly.

15. The refillable container according to claim 14, wherein the pair of arcuate portions is opposite to each other in a circumferential direction and wherein the pair of arcuate portions each includes a first end connected to the button portion and a free second end.

* * * * *